US006834731B2

(12) United States Patent
Burlingame et al.

(10) Patent No.: US 6,834,731 B2
(45) Date of Patent: Dec. 28, 2004

(54) STAPLE GUN APPARATUS FOR ATTACHING TAB

(75) Inventors: Mark Burlingame, Sherwood, OR (US); Cory Burlingame, Sherwood, OR (US)

(73) Assignee: Columbia River Staple & Lumber Wrap, Inc., Aloha, OR (US)

( * ) Notice: Subject to any disclaimer, the term of this patent is extended or adjusted under 35 U.S.C. 154(b) by 0 days.

(21) Appl. No.: 10/635,766

(22) Filed: Aug. 6, 2003

(65) Prior Publication Data

US 2004/0108354 A1 Jun. 10, 2004

Related U.S. Application Data

(60) Provisional application No. 60/402,303, filed on Aug. 9, 2002.

(51) Int. Cl.[7] ..... B25C 7/00

(52) U.S. Cl. ..... 173/18; 173/8; 173/119; 173/138; 221/232; 221/238; 221/257

(58) Field of Search ..... 227/8, 119, 15, 227/18, 138, 120, 37; 221/232, 238, 1, 239, 257, 270

(56) References Cited

U.S. PATENT DOCUMENTS

| | | | | |
|---|---|---|---|---|
| 2,585,942 A | | 2/1952 | Juilfs | |
| 3,583,496 A | | 6/1971 | Fehrs | |
| 3,595,460 A | | 7/1971 | Pitkin | |
| 3,734,377 A | | 5/1973 | Munn | |
| 3,946,927 A | | 3/1976 | Fehrs | |
| 3,957,192 A | | 5/1976 | Fehrs | |
| 3,992,768 A | | 11/1976 | De Nicola et al. | |
| 4,033,499 A | | 7/1977 | Butler | |
| 4,121,745 A | | 10/1978 | Smith et al. | |
| 4,182,474 A | | 1/1980 | Sato | |
| 4,215,808 A | | 8/1980 | Sollberger et al. | |
| 4,232,810 A | | 11/1980 | Russell | |
| 4,265,387 A | | 5/1981 | Strouse | |
| 4,339,065 A | * | 7/1982 | Haytayan | 227/8 |
| 4,432,483 A | | 2/1984 | Kuck | |
| 4,856,696 A | | 8/1989 | Seld | |
| 4,998,662 A | | 3/1991 | Hasan et al. | |
| 5,014,896 A | | 5/1991 | Reitmeier et al. | |
| 5,184,752 A | * | 2/1993 | Zylka et al. | 221/1 |
| 5,193,729 A | | 3/1993 | Dewey et al. | |
| 5,195,672 A | | 3/1993 | Souverain | |

(List continued on next page.)

OTHER PUBLICATIONS

Brochure for Fastagger™ Stapler, Weber® Labeling & Coding Solutions, Mar. 2003, 2 pages.

*Primary Examiner*—Scott A. Smith
(74) *Attorney, Agent, or Firm*—Roberts Abokhair & Mardula LLC

(57) ABSTRACT

The invention comprises a staple gun with highly compact accessory apparatus for attaching a planar tab or label to a fixing surface. The accessory has a housing and a positioning and indexing assembly associated with the housing which is operable to feed and hold a tab or label between the staple gun head and fixing surface, thereby allowing single-handed fixing of a label or tab to a fixing surface. The apparatus can include a roller assembly, staple gun and accessory apparatus or have all components integrated into the construction of a staple gun apparatus. Preferably, the apparatus is mated with a tab or label holding magazine. Some exemplary embodiments of the invention are suitable for securing protective covering to lumber product and may be configured for rectangular polyolefin tabs measuring approximately 0.035 inch thick and 1.0 inches by 2.0 inches.

47 Claims, 23 Drawing Sheets

U.S. PATENT DOCUMENTS 5,208,962 A 5/1993 Walker, Jr.
5,259,826 A 11/1993 Woods
5,292,048 A 3/1994 Vanderwiel
5,445,297 A * 8/1995 Beach et al. ..... 221/257
5,634,583 A 6/1997 McGuinness et al.
5,660,315 A 8/1997 Beavers et al.
5,733,089 A 3/1998 Albright
5,918,790 A 7/1999 Donnell
5,934,504 A 8/1999 Elliott
5,947,362 A 9/1999 Omli
6,039,232 A 3/2000 Snover
6,065,660 A 5/2000 Cabrera
6,212,762 B1 4/2001 Lucier
6,302,310 B1 * 10/2001 Lamb ..... 227/119
6,305,891 B1 10/2001 Burlingame
6,478,209 B1 * 11/2002 Bruins et al. ..... 227/16
6,508,392 B1 * 1/2003 Huang ..... 227/18
6,529,799 B1 3/2003 Paulk, Jr. et al.

* cited by examiner

STAPLE GUN APPARATUS FOR ATTACHING TAB

CROSS REFERENCE TO OTHER PATENT APPLICATIONS

This invention claims priority under 35 U.S.C. §119 to U.S. provisional patent application Ser. No. 60/402,303 filed Aug. 9, 2002, which is incorporated by reference in its entirety.

BACKGROUND OF THE INVENTION

This invention relates to a staple gun and will have specific reference to a staple gun for attaching tabs or labels to wood products and the like.

It is becoming common place for lumber companies and mills to use labels bearing bar codes, commonly referred to as UPC labels, for inventory control and computer pricing. Previously such labels were attached by a user carrying a roll of the UPC labels placing one against the board, stapling it to the board and then severing the stapled label from the remainder of the roll. This process, when performed by hand, is very time consuming which increases the price of lumber to the consumer.

Lumber is often shipped great distances and stored in harsh environmental conditions for extended periods of time. In particular, the lumber may be left on sea docks or in open lumberyards for months at a time. During these periods the lumber is subject to harsh environmental conditions such as rain, snow and high winds, and other conditions such as pollution and bird droppings. During transit on trains or on open semi-tractor trailers, the lumber units may be subjected to flying debris such as small sticks and stones, which may hit the lumber at speeds of seventy miles an hour. Due to the high cost of lumber, and in order to minimize the damage done to the lumber during transport and storage, it is desirable to protect the lumber from exposure to these harsh environmental conditions.

Lumber units, which are shipped in a variety of sizes, typically are wrapped in a protective covering, such as Nova-Thene Plus TP (Trademark owned by Intertape Polymer Group of Nova Scotia, Canada), a high strength, lightweight coated fabric consisting of a reinforcing high density polyethylene scrim coated on both sides with a film of low density polyethylene blended with other specialty resins. The protective covering typically is secured to the lumber unit by fasteners such as staples that are shot from a staple gun through the covering and into the lumber. The staple typically retains the sheeting on the lumber unit during transport and storage but must be removed prior to sale or use of the lumber.

When covered lumber unit is subjected to high winds, the high winds may tend to tear the protective covering from the lumber unit due to the small surface area of the staple in contact with the cover. In other words, as the covering is pulled from the lumber, the staples tend to tear through the cover (termed staple "pull through"). Moreover, during purposeful removal of the covering from the lumber prior to use, pulling of the covering from the lumber tends to result in the staple tearing through the cover such that the staples remain in the lumber. When staples remain in the lumber, the staples may damage or destroy saw blades used to cut the lumber. Partially removed staples with a single leg remaining in the product ("leg-out" condition) are also hazardous to personnel who may be injured from the protruding staple leg. In addition, staples left remaining in the lumber mar the appearance of the lumber and decrease the value of expensive specialty lumbers.

One solution is to secure the protective cover to the lumber by use of a polymeric tab, stapled through the covering into the product. Tabs are used to distribute strain on the protective covering. This reduces staple pull throughs providing for a stronger and more durable covering. The tabs can be imprinted with the company's trademark, safety designation, product information, etc. During purposeful removal of the cover, the tabs and staples normally come free. Experience has shown that 95% to 100% of the staples will be thus removed when tabs are used.

Presently the tabs are separately positioned and stapled. This results in higher labor expenditures and requires two-handed operation. Because the protective covering must also be held in position during the stapling process, two workers are typically required (first worker holds the covering in place, second worker positions and staples tab).

When only a single worker is available, the awkwardness of affixing a tab is quickly apparent. First the covering is brought into position and a tab positioned. The worker uses one hand to both hold the tab in position as well as holding the covering in position then uses the other hand to operate the staple gun. This awkwardness leads to many poorly covered products as either the covering or tab slips before the staple is driven. Worker injuries also occur when staple guns are engaged prematurely or staples penetrate into the hand holding the tab in position.

It is therefore desirable to reduce the labor requirements, injuries and awkwardness of affixing tabs and labels to lumber and products covered with protective coverings.

BRIEF SUMMARY OF THE INVENTION

This invention eliminates the above problems by providing a highly compact staple gun accessory capable of carrying and feeding a group of labels or tabs. The accessory feeds and holds a single label when the staple gun is pressed against the product. The positioning is situated so that the label or tab is held between the staple gun head and the product. When the gun trigger is pulled a staple is driven from the staple gun, in common manner, through the label or tab into the product. Typically, the gun will then be positioned at a second area of the label or tab and a second staple will be driven through the label or tab into the product. The staple gun will then be retracted away from the surface of the product.

In one embodiment, each time the staple gun is brought in contact with the product, a new label or tab is fed into position automatically. In this manner, labels or tabs are positioned and affixed to a product in a single-handed operation. The staple gun accessory is highly compact thus reducing user fatigue associated with heavy and bulky staple gun accessories.

Other objects of this invention will become apparent upon a reading of the following description taken with the accompanying drawings.

DETAILED DESCRIPTION OF THE INVENTION

The preferred embodiment herein disclosed is not intended to be exhaustive or limit the application to the precise form disclosed. Rather it is intended to enable others skilled in the art to utilize its teachings.

Figure 1:
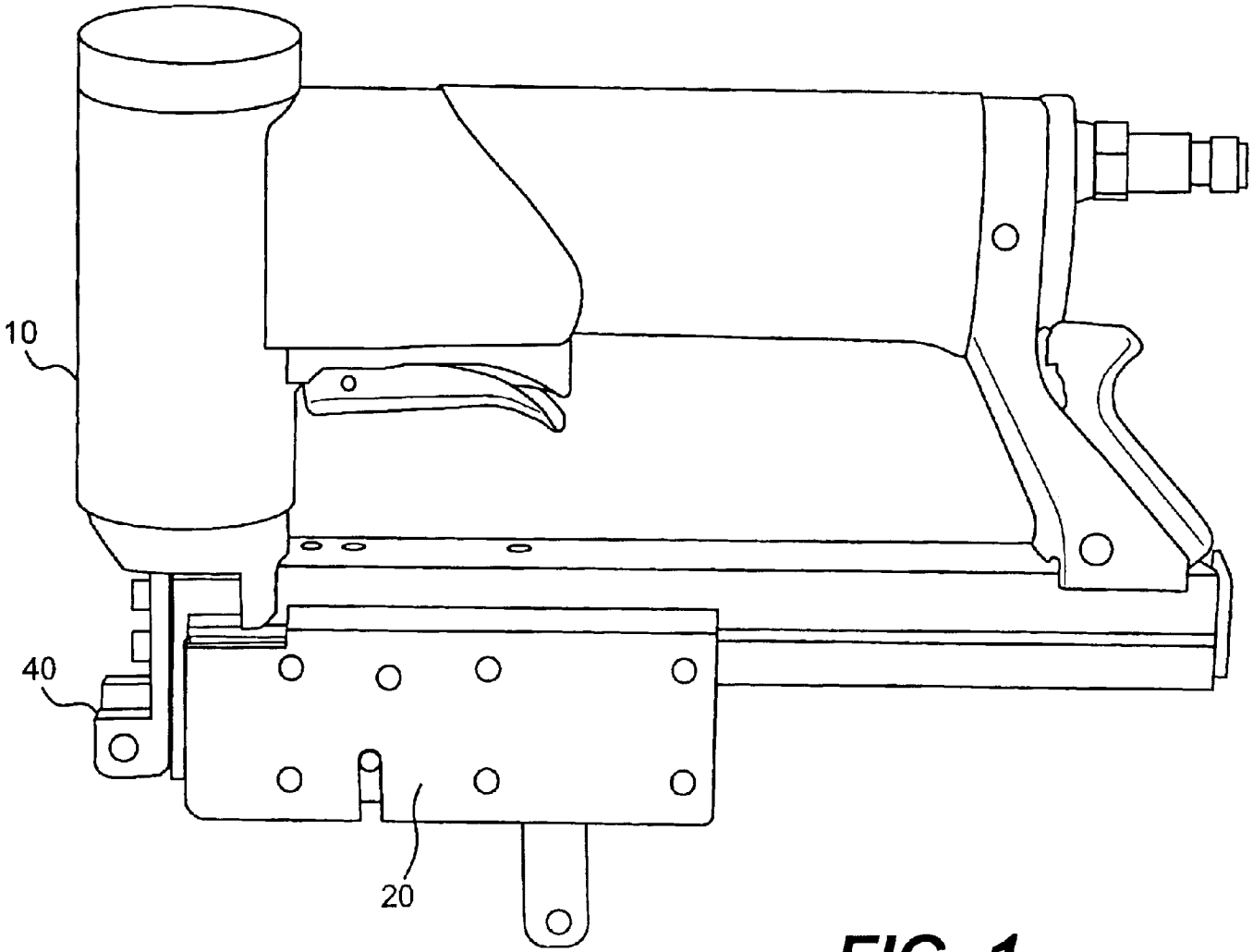
FIG. 1 illustrates one embodiment of the invention depicting major components.

Referring now FIG. 1, tab and label stapler apparatus includes a common staple gun 10 having a tab and label feeding attachment 20 connected thereto. Optionally, front guide assembly 40 is attached to the staple gun 10. The front guide assembly permits accurate positioning of the staple gun against the product and allows the user to slide the staple gun parallel to the direction of the tab or label without marring or disturbing the finish of product, tab or label.

Staple gun 10 is a common staple gun and is available from a number of manufacturers including ATRO, Behrens, Carton Closer Tools, Duo-Fast, Fasco, Jamerco, Josef Kihiberg (JK), Hitachi, ITW Paslode, SENCO, Spotnails, Stan-Tech, Stanley Bostitch, Unicatch. Staple guns may be pneumatically, electrically or manually actuated. Electrically actuated staple guns may also utilize electrical storage battery for the source of power. Particularly preferred for high cycle use are the pneumatically operated staple guns.

The staple gun depicted in FIG. 1 through FIG. 5 is a Behrens 380/16-400 series staple gun. It will be readily apparent to those skilled in the art how the invention is assembled to other common staple guns. According to this embodiment, tab and label feeding attachment 20 is highly compact. As used herein, "highly compact" refers to extending less than 0.5 inches past any side of staple gun means 10 or side of a planar material segment, extending less than 0.5 inches below staple gun means 10 when the contactor is compressed and extending less than 1.0 inch below staple gun means 10 when the contactor is released.

Figure 2:
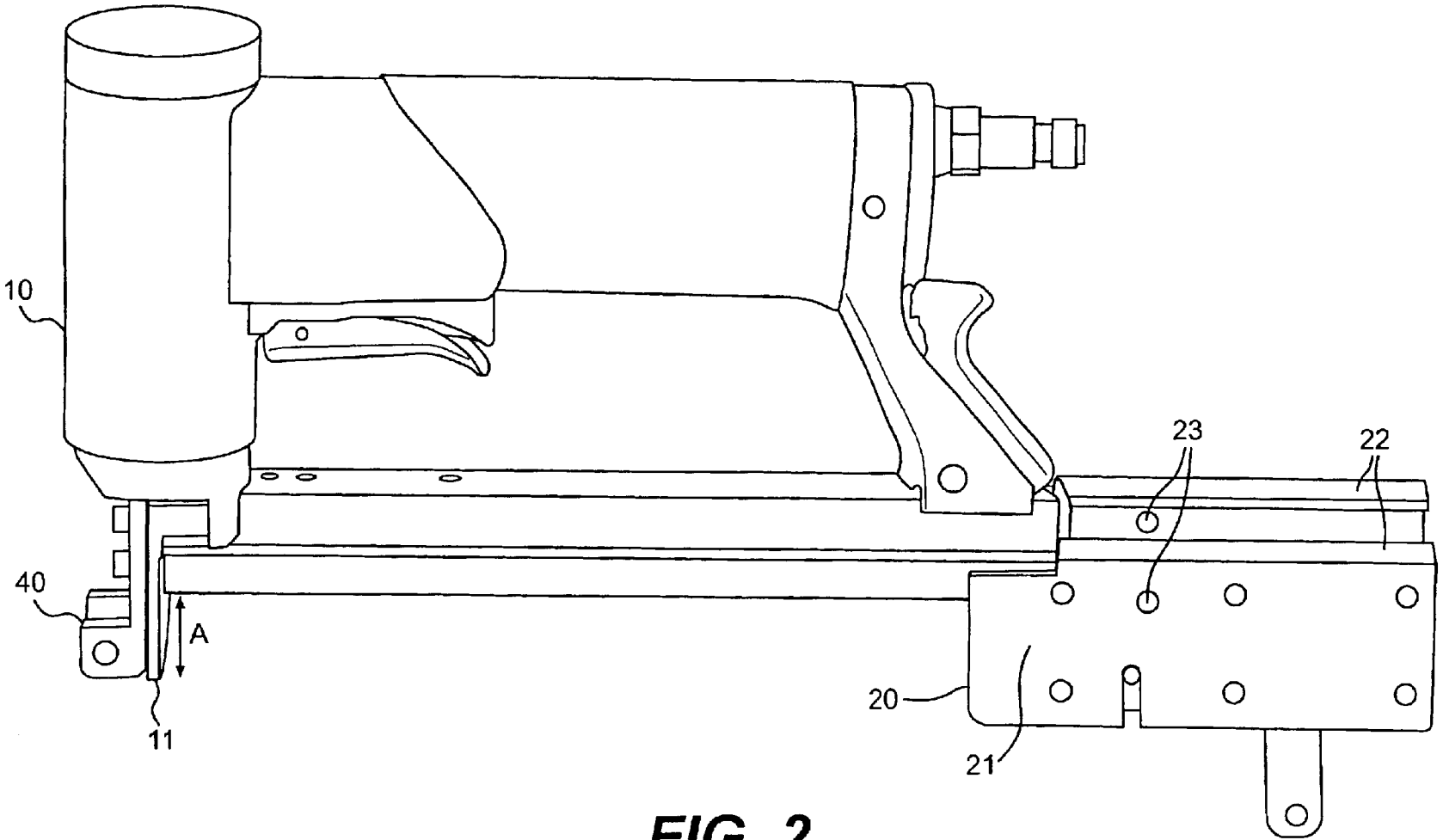
FIG. 2 illustrates one embodiment of the invention depicting major components and identifying dimension "A"

The construction and operation of staple gun 10 is common in the industry and does not constitute a novel portion of the invention. Preferred staple guns are as illustrated in FIG. 2 with extended stapling head 11 protruding below the base of the gun. Such staple guns have a dimension "A" of 25 mm or greater. As is further described below, the number of labels or tabs that can be held in a tab and label magazine is affected by this dimension.

In a preferred embodiment, the tabs and labels suitable for use with this invention are either in the form of "planar material segments" or "separable planar material segments" as opposed to continuous rolls or tapes that must be cut to a desired length. As a result, the apparatus of the present invention is simplified and a segment cutting means is not required. Planar material segments are individual pieces of material that are not interconnected. Separable planar material segments are planar material segments connected by weakened areas. The weakened areas allow the topmost tab or label to separate when it is positioned for stapling.

As used herein "tab and label feeding attachment" refers to a staple gun attachment apparatus useful for feeding either tabs or labels with adjustments made to accommodate the tab or label being used. As used herein "tab feeding attachment" refers to a staple gun attachment apparatus useful for feeding tabs but not labels. Whereas labels are used primarily to identify products, tabs are used primarily to secure protective coverings with reduced staple pull through. In general tabs and labels are distinguished by their thickness. Tabs have a thickness in excess of 0.015 inch and preferably a thickness between 0.025 and 0.050 inches. Labels may be much thinner, for example 0.010 inch or less as they do not necessarily provide for reduced staple pull through.

Tab and label feeding attachment 20 in the figures is attached to staple gun 10 by means suitable for the staple gun. For example, in the case of a Behrens staple gun with a rail flange, the feeding attachment may be assembled to the gun using capturing flanges 22 and setscrews 23.

Figure 3A:
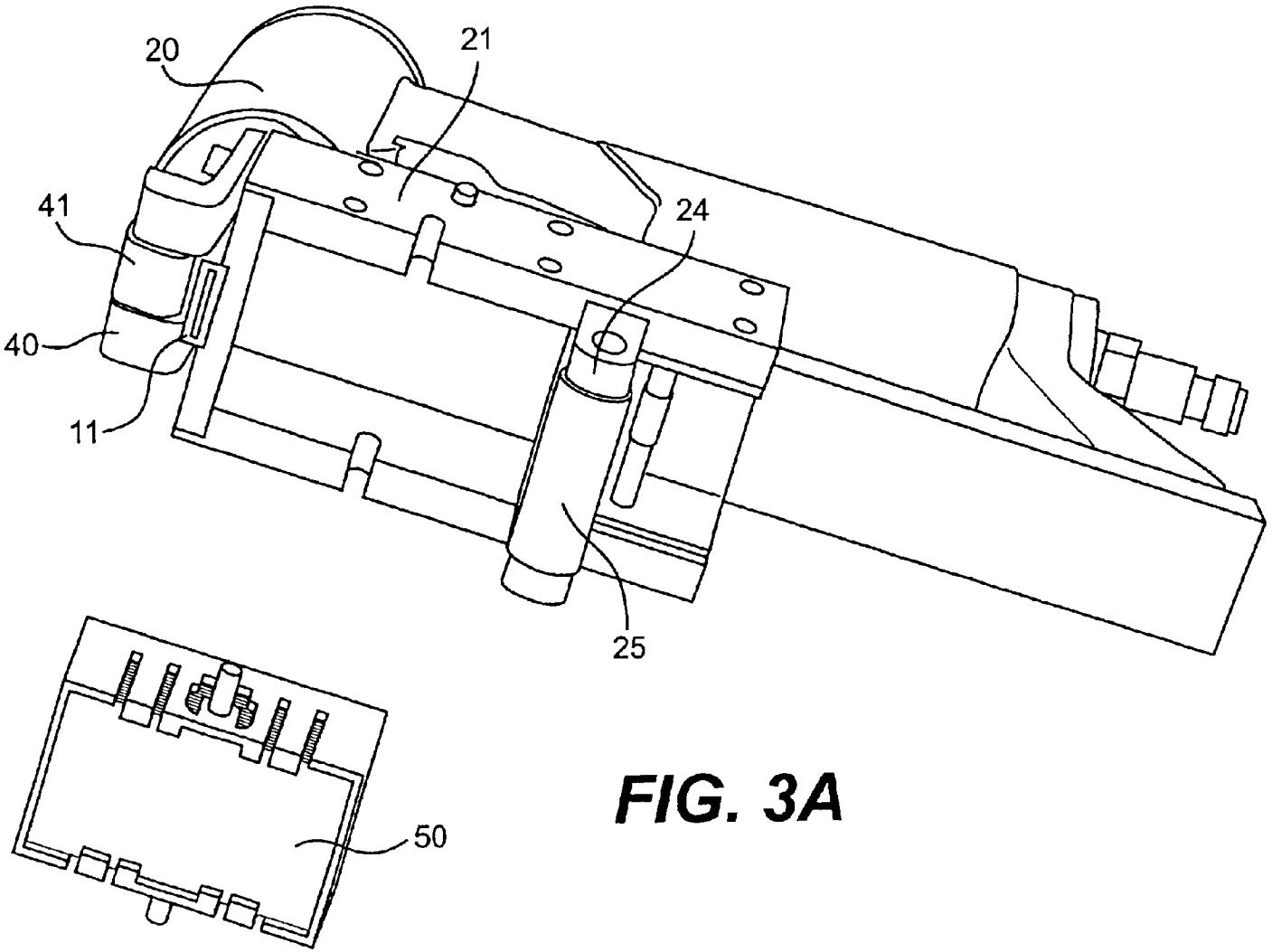
FIGS. 3A and 3B illustrate various views of an embodiment of the invention identifying components.
Figure 3B:
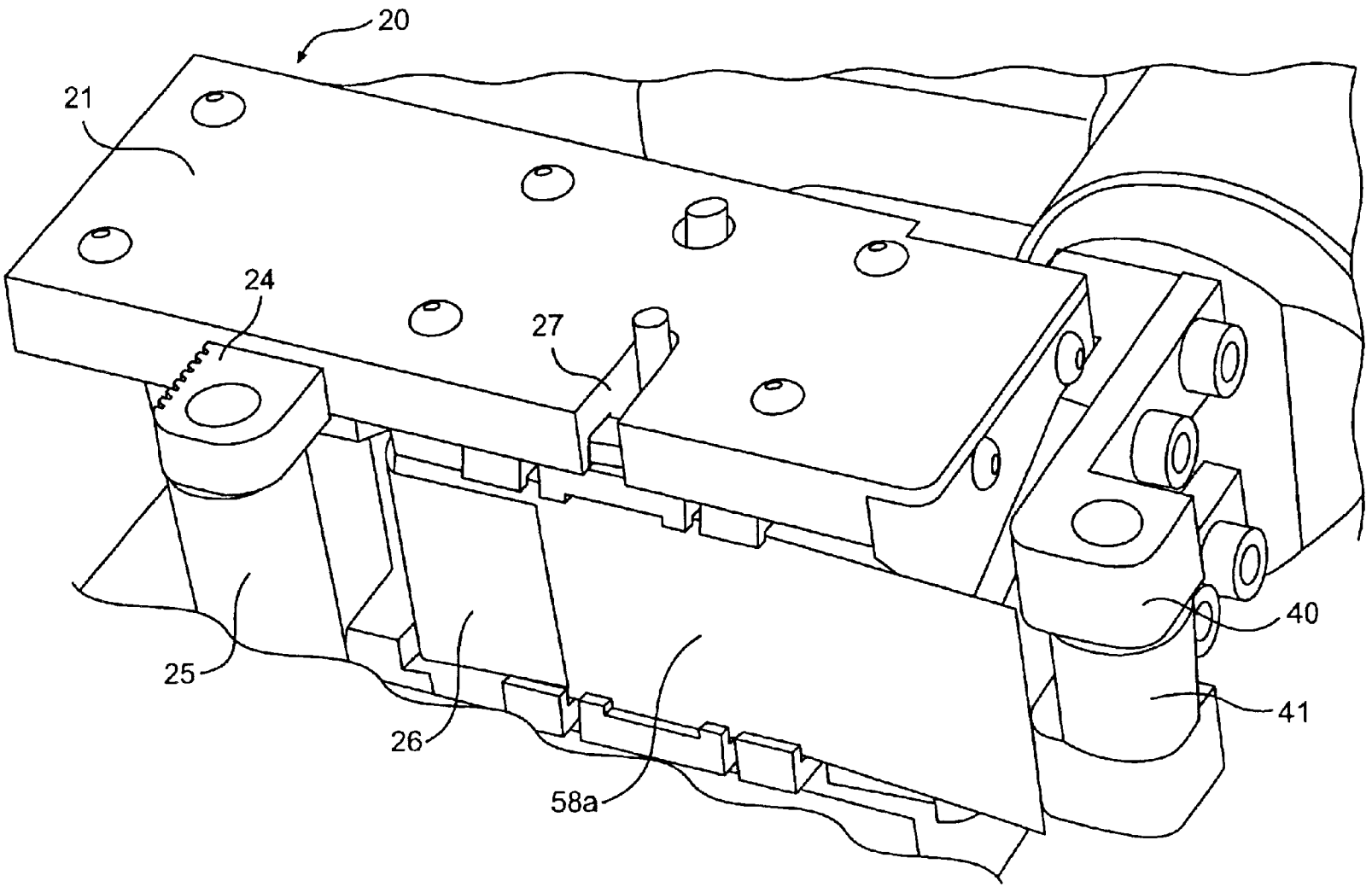

Tab and label feeding attachment 20 includes a main housing 21 which holds tab and label magazine 50, as illustrated in FIG. 3A and FIG. 3B. It further comprises tab and label indexing mechanism (depicted generally as 24). Indexing mechanism 24 may be any means that feeds a label or tab to a position under the stapling head 11. In one preferred embodiment, the indexing mechanism consists of a plunger 24, gear assembly (not shown), torsion spring assembly (not shown) and indexing slide 26. As plunger 24 is depressed against the spring return, the cam assembly advances indexing slide 26 thereby feeding a label or tab to the desired position. When pressure is removed from plunger 24, it is returned to the extended position by the spring return. Simultaneously, indexing slide 26 returns to its original position by the action of the cam assembly. In this fashion, a single label or tab is fed to underneath staple gun head 11 each time the plunger 24 is depressed and released.

Although the preferred embodiment utilizes a gear assembly and torsion spring assembly, this is in no way limiting. For example, other means of mechanically linking the indexing slide to the plunger action are possible. One such means is a cam arrangement where as plunger 24 is depressed indexing slide 26 advances. Another such means is a slot and post or slot and key. Further a gear assembly may use a worm gear, rack and pinion, or a piston assembly.

As is seen in FIG. 3B, both plunger 24 and guide 40 may be equipped with rollers 25 and 41. These rollers are not essential to the invention and may be omitted if desired. When supplied, they act to reduce friction between the product or protective wrap and the staple gun apparatus. Rollers 25 and 41 are preferred when the product or protective packaging is easily damaged.

Of importance is the thickness of indexing slide 26. Indexing slide 26 is typically manufactured to a thickness slightly less than that of a single label or tab. As a result, as indexing slide 26 extends, a single label or tab will be positioned, with other labels or tabs remaining undisturbed in magazine 50.

Figure 3C:
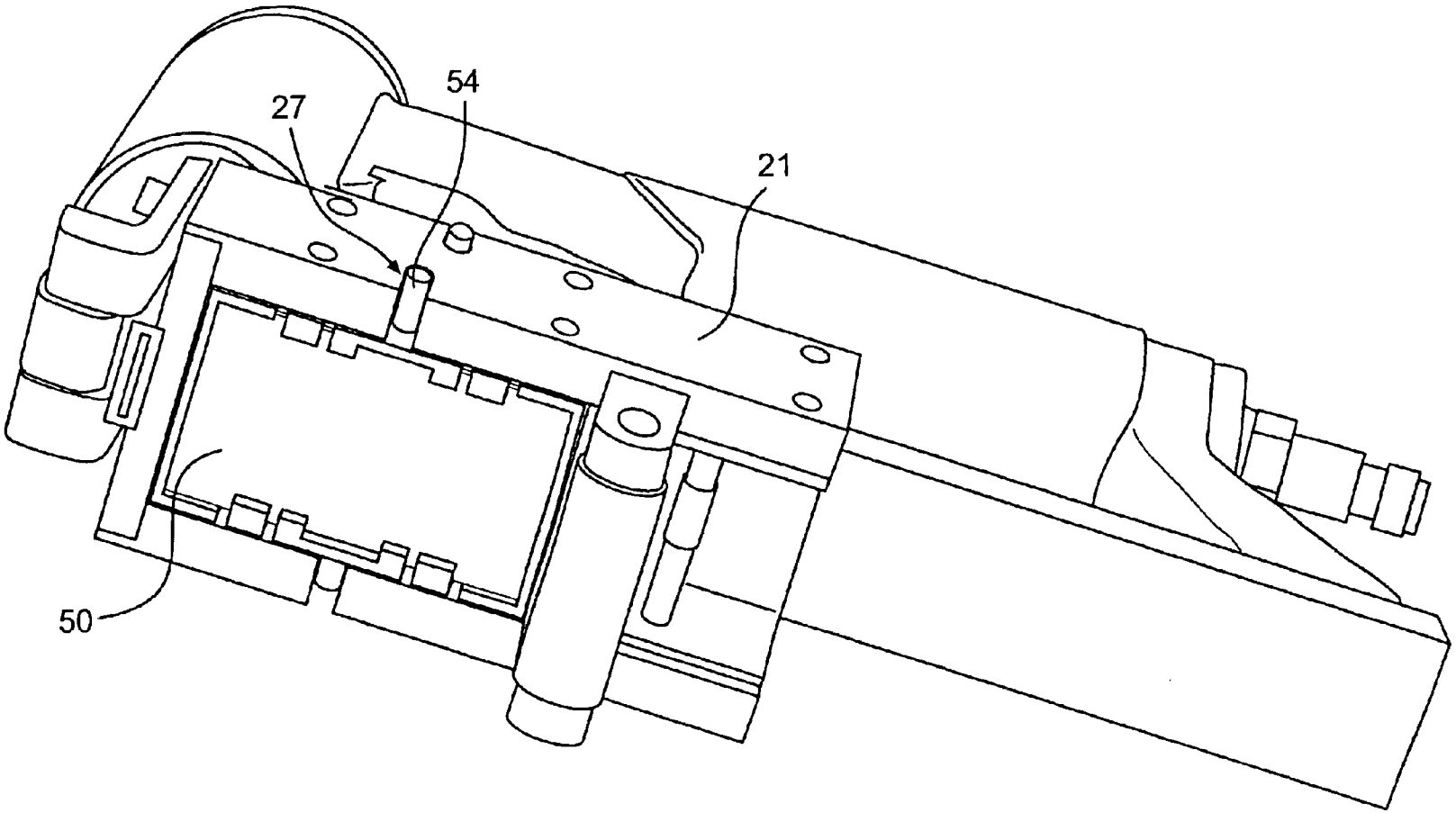
FIG. 3C illustrates one embodiment of the invention depicting insertion of a tab magazine or label magazine into the dispenser housing.

FIG. 3C illustrates one embodiment of locking a tab and label magazine 50 into housing 21. Magazine lateral supports 54 are captured in the housing channel 27. Various means and arrangements can be used to lock the magazine into place. For example, a protuberance in the channel 27 past which lateral supports 54 must pass when magazine 50 is inserted is one preferred embodiment. Other convenient means of attachment are readily apparent to those skilled in the art and intended to be within the scope of the invention.

It is noted that the tab and label magazine may also be incorporated into housing 21. In such embodiments, tabs or labels are loaded directly into the tab and label feeding attachment. Resulting feeder attachments operate in accordance with other embodiments described herein with the exception that the magazine is not separate or removable.

FIGS. 4A, 4B, 4C and 4D illustrate the various components of one preferred embodiment of a tab and label magazine. A magazine may incorporate a magazine housing 51, one or more coil springs 56 (see FIG. 4B), pusher plate 57 (see FIG. 4C) and labels or tabs to be contained (for example 58*a* through 58*r* of FIG. 4D).

Figure 4A:
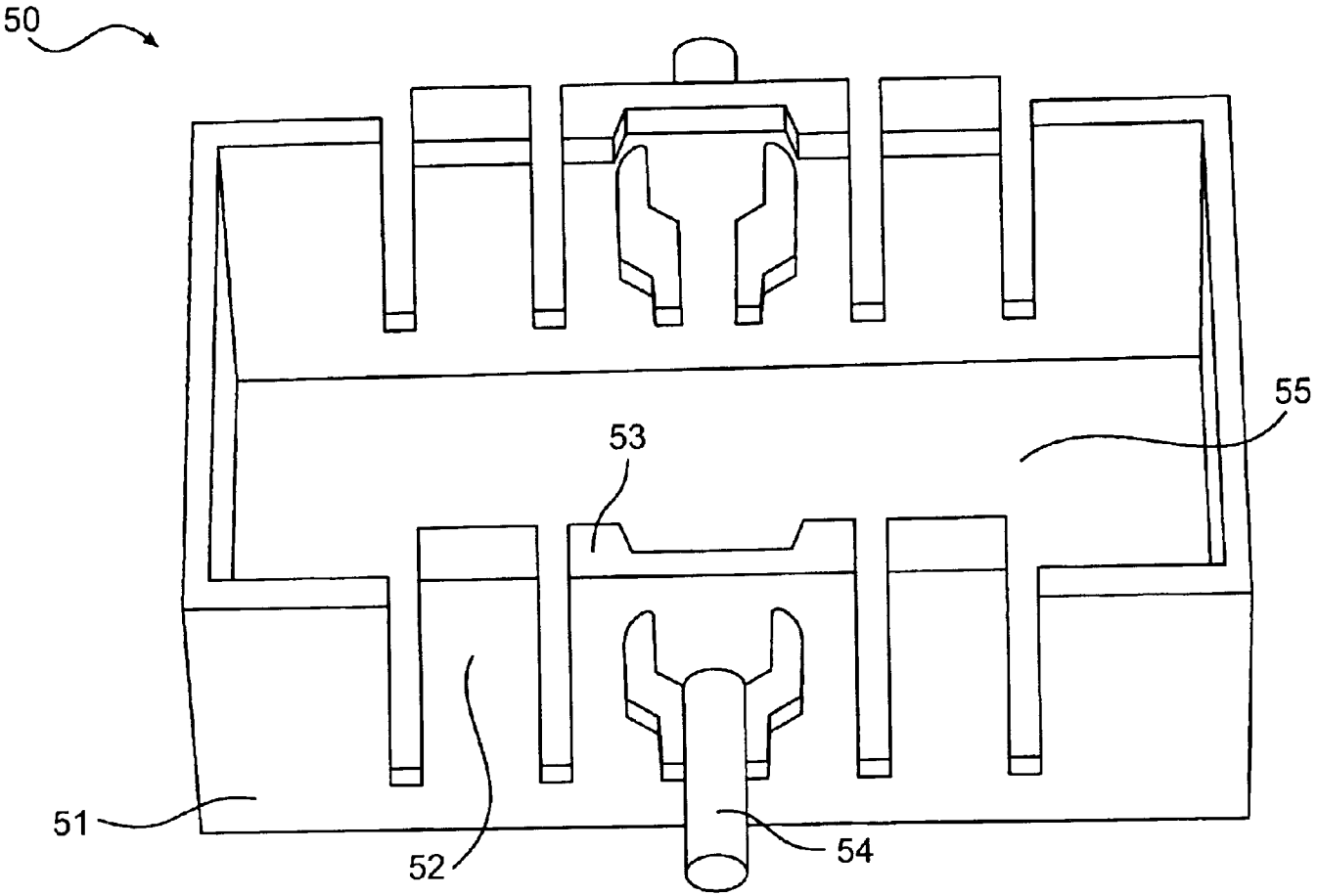
FIGS. 4A, 4B, 4C and 4D illustrate various views of an embodiment of a tab magazine or label magazine.

FIG. 4A illustrates one embodiment of a magazine housing 51. The magazine housing may be manufactured of any convenient material, for example, polymers, metals, etc. FIG. 4A illustrates the use of polypropylene, but other polymers are equally suitable and include, without limitation, polyethylene, polypropylene, acrylonitrile-butadiene-styrene (ABS), polyamides, polytetrafluoroethylene, linear polybut-1-ene, polyisoprene, polybutadiene, ethylene-alkyl acrylate copolymers, ethylene-alkylmethacrylate copolymers, ethylene-vinylacetate copolymers, ethylene-acrylic acid copolymers, polystyrene, styrene-butadiene, styrene-acrylonitrile (SAN), styrene-ethyl methacrylate, styrene-butadiene-ethyl acrylate, styrene-acrylonitrile-methacrylate, methylmethacrylate-butadiene-styrene (MBS), polyvinyl chloride, polyvinyl fluoride, polyvinylidene fluoride, polyacrylates, polymethacrylates, polyacrylamides, polyacrylonitriles, polyvinyl alcohol, polyvinyl acetate, polyurethanes, polyureas, polyphenylene ethers, polyesters, polycarbonates, polyoxymethylenes, polysulfones, polyether sulfones, polyether ketones, etc.

As illustrated in FIG. 4A, magazine housing 51 comprises an open area to contain labels or tabs, tab and label capturing elements 52, 53 and lateral supports 54. Tab and label capturing elements have upper flanges that extend inward to hold the labels or tabs. Capturing elements preferably also flex outward to allow for easy insertion of labels or tabs. The height of the flange above the base of the magazine housing correlates with staple gun dimension A (see FIG. 2). With magazine 50 inserted into feeder housing 21, the bottom of these flanges is extending beyond dimension A by 125% to 150% of the thickness of a label or tab. Magazine housing 51 may also comprise indentations 55 that accept coil springs and resist spring movements caused from vibrations during operation.

Figure 4B:
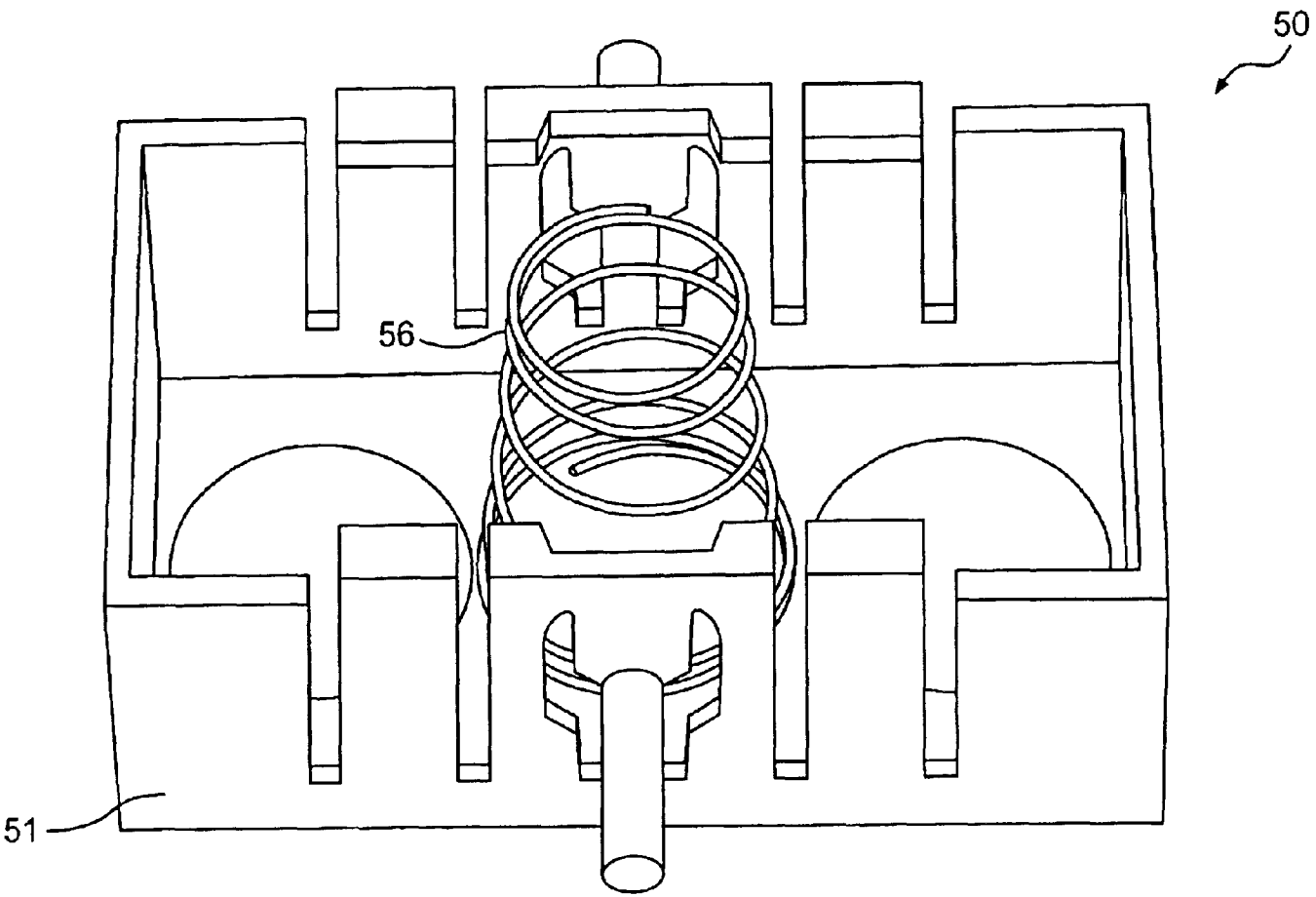

FIG. 4B illustrates the placement of a single coil spring 56 inside a magazine housing 51. As illustrated, one, two or three coil springs may be utilized. It is preferable that coil spring 56 compress into a low profile as a lower profile allows more labels or tabs to be inserted into a single magazine.

Figure 4C:
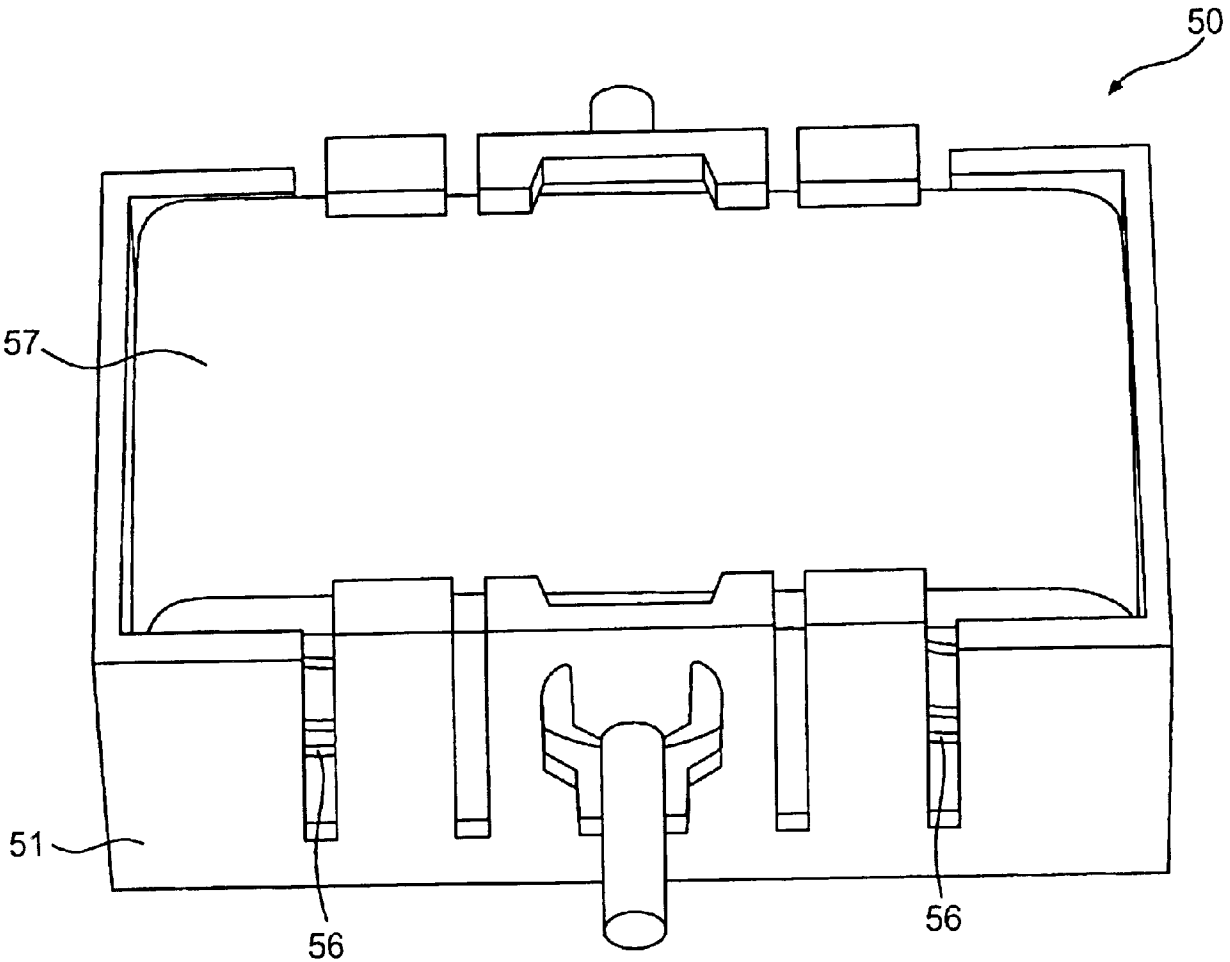

FIG. 4C illustrates the placement of pusher plate 57 inside a magazine housing 51. As illustrated, pusher plate 57 restrains two coil springs 56, although other numbers of coil springs will also function properly. Pusher plate 57 is preferably tapered on each lateral end. When the magazine is empty of labels and tabs, engagement between indexing slide 26 and pusher plate 57 is thereby avoided. Tapered ends of pusher plate 57 also reduce snagging between pusher plate 57 and labels or tabs. Pusher plate 57 is restrained inside magazine housing 51 by flanges on tab and label capturing elements 52 and 53 (illustrated in FIG. 4A). Preferably pusher plate 57 has an upper flat surface. A flat surface holds the labels or tabs in a flat condition and further minimizes snagging.

Figure 4D:
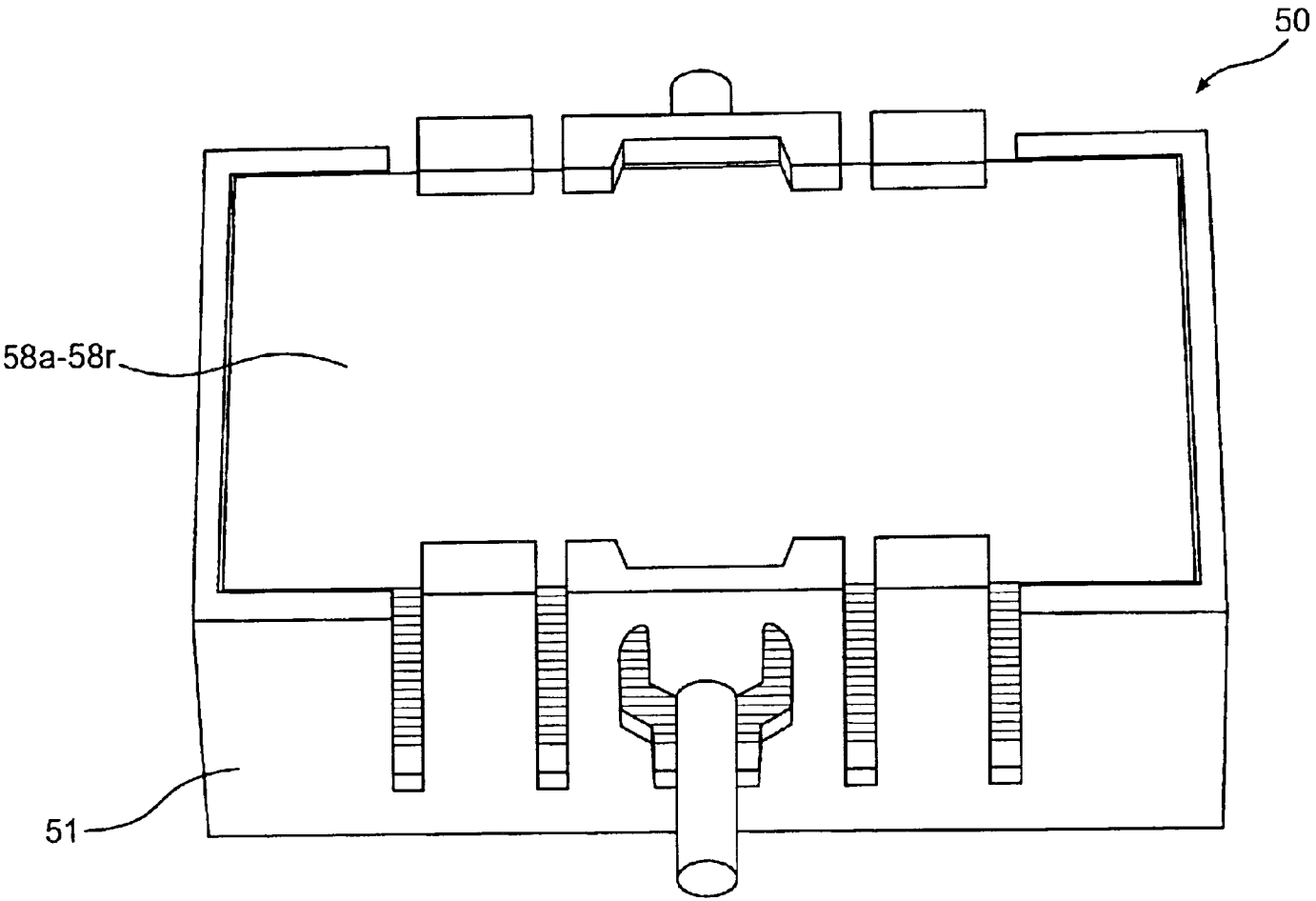

FIG. 4D illustrates a tab and label magazine loaded with labels or tabs 58*a* through 58*r*. The number of labels or tabs depends upon the thickness of the tabs and dimension A of the staple gun. The thinner the labels or tabs and the larger dimension A, the greater the number of labels or tabs that are contained in a given magazine 50. For example, for a dimension of A associated with a standard Behrens Model 380 staple gun, approximately 18 tabs of thickness 0.035 inches are held in the tab and label magazine. If tab thickness is reduced to 0.025 inches, the number of tabs the magazine can hold increases to 25. In either case, the indexing slide thickness must be comparable with tab thickness.

Figure 9A:
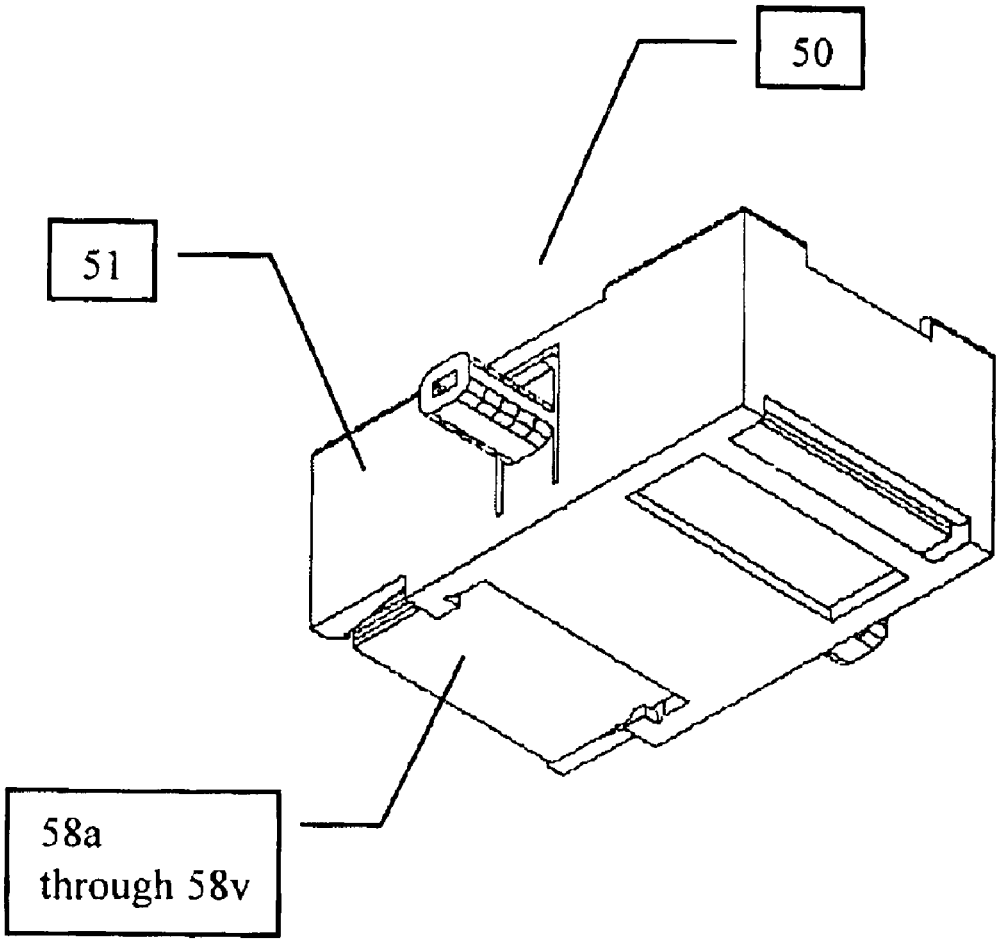
FIG. 9A illustrates a tab and label magazine with tabs 58*a* through 58*v;*

FIG. 9A illustrates another embodiment of a magazine housing. This embodiment differs by the way in which tabs are filled into the resultant label and tab magazine. When using the magazine housing of FIG. 4A, tabs are filled into the magazine by pressing them into the magazine from the top. In the embodiment of FIG. 9A, tabs are filled into the magazine from the end.

Figure 5A:
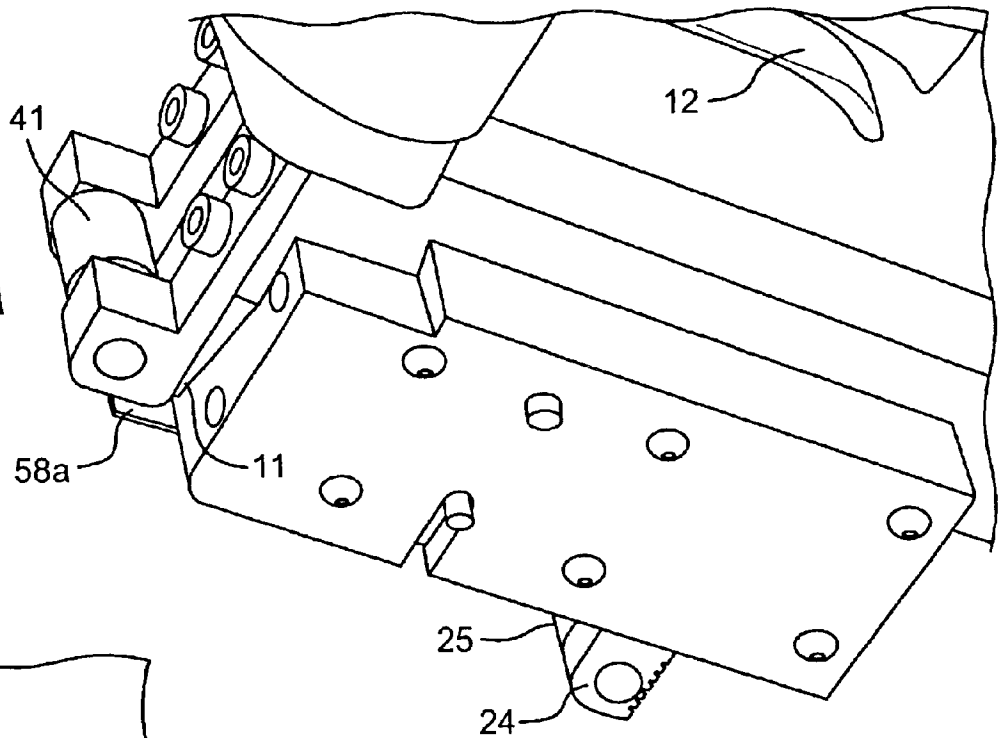
FIG. 5A illustrates use of one embodiment of the present invention.

FIG. 5A illustrates the single-handed operation of one preferred embodiment of the present invention. The staple gun apparatus is located against the product to which the label or tab is to be affixed. Conveniently, the front edge of roller guide may correspond to the final front edge of the affixed label or tab. Next, plunger 24 is compressed against the product. As plunger 24 compresses, the cam assembly slidably feeds a single label 58*a* forward to under the staple gun head 11. Pressing trigger 12 initiates the expulsion of a staple through the label or tab into the product.

Figure 5B:
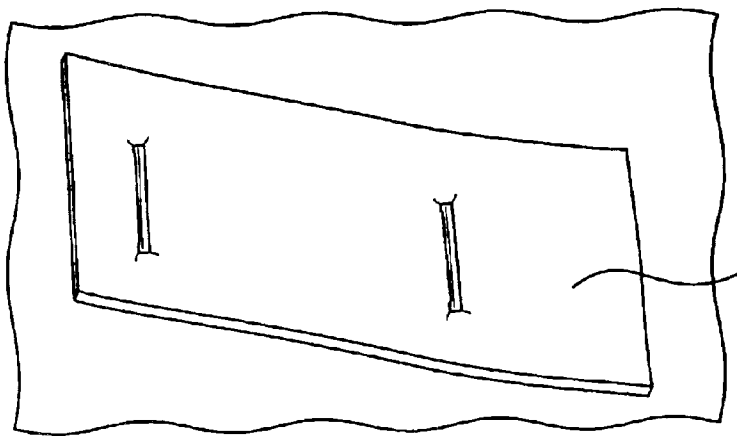
FIG. 5B illustrates a tab affixed to a product with a first and a second staple.

Next the staple gun head is moved parallel to the label or tab and trigger 12 is pressed, thereby affixing the label or tab to the product with additional staple(s). When provided, rollers 25 and 41 aid in moving the staple gun head parallel to the label or tab. FIG. 5B illustrates the result of the operation of the staple gun apparatus.

As is seen, the invention provides a convenient and economical means of affixing a label or tab to a product with multiple staples in a single-handed operation. The apparatus can be fashioned by adding an accessory to a standard staple gun or by integrating the design into the frame of a staple gun.

When desired a printing device can be incorporated into the front guide assembly 40. This permits the printing of serial numbers onto the labels or tabs as they are affixed to the product.

Figure 6:
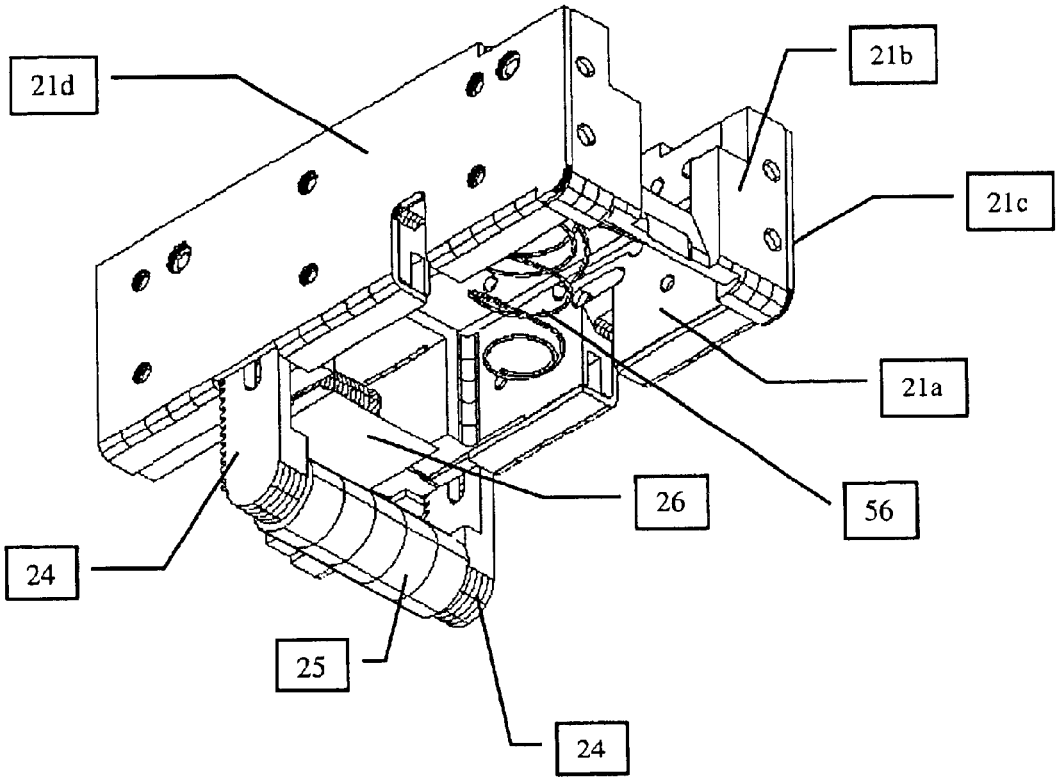
FIG. 6 illustrates another embodiment of a tab and label feeding attachment.
Figure 7A:
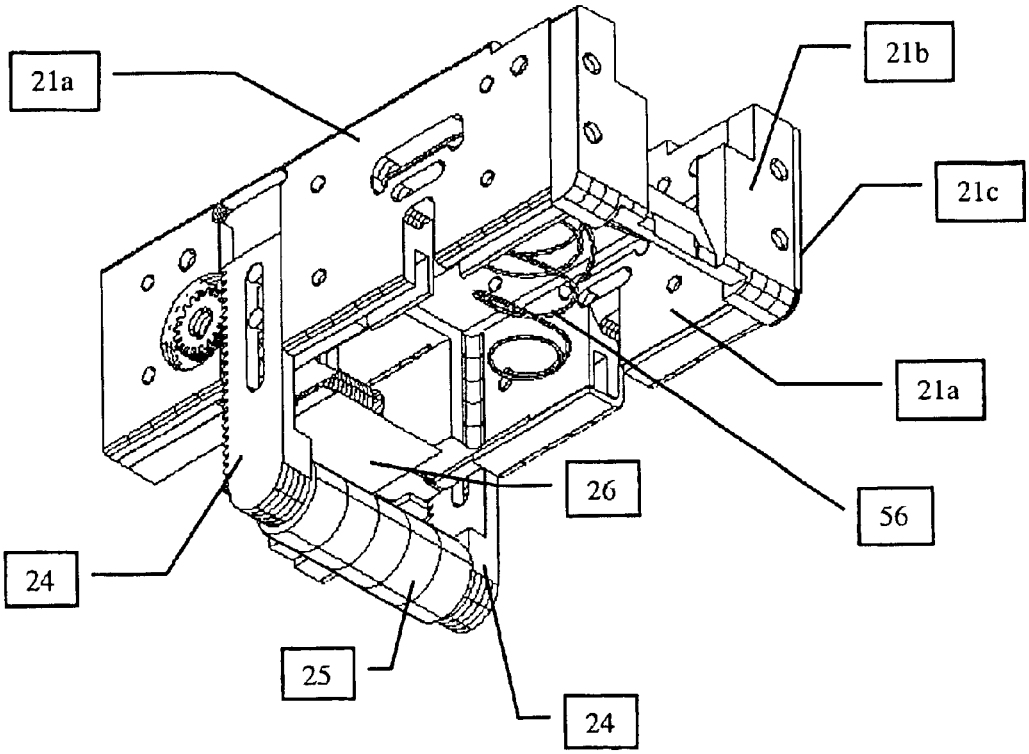
FIG. 7A illustrates the tab and label feeding attachment of FIG. 6 with one of the retaining covers removed.

FIG. 6 illustrates another embodiment of the tab and label feeding attachment. Major components include housing structure 21*a*, front housing structure 21*b*, retaining covers 21*c* and 21*d*, and tab indexing mechanism comprising plunger 24, contact roller 25 and indexing slide 26. FIG. 7A has retaining cover 21*d* removed to reveal additional features. Subsequent figures illustrate the components of this tab and label feeding attachment in greater detail.

In contrast to the earlier described embodiment, this embodiment uses a tab and label pressure spring 56 that is fixedly attached to the feeding attachment instead of being incorporated into a tab and label magazine. Fixing the spring to the attachment allows for reduced complexity and manufacturing costs of the magazine as well as increased capacity of the magazine. For example, this embodiment allows the magazine to hold 22 tabs of thickness 0.035 inch instead of 18 tabs of the earlier described embodiment.

Figure 7B:
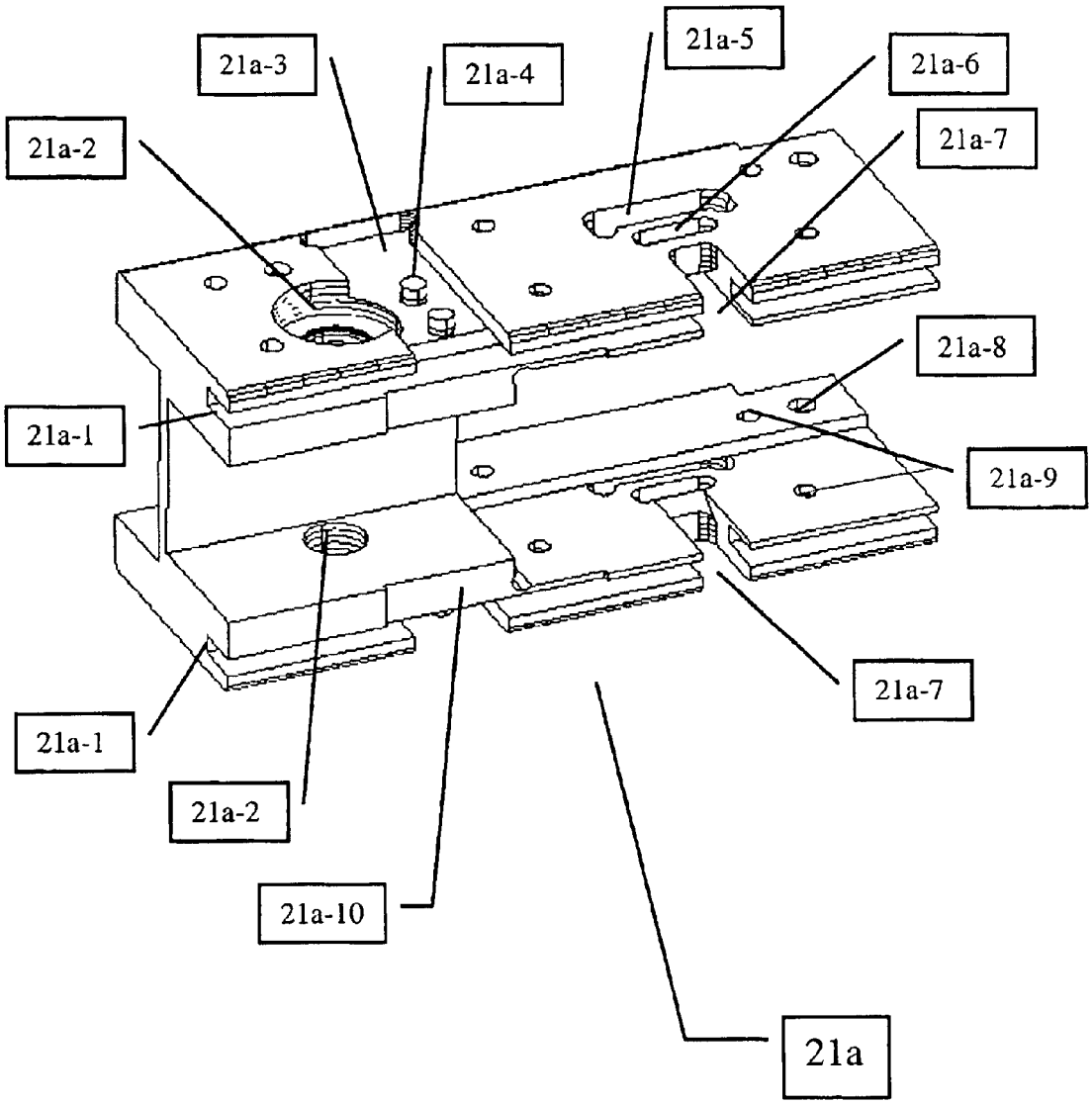
FIG. 7B illustrates a housing structure of the tab and label feeding attachment of FIG. 6.

Housing support structure 21*a* illustrated in FIG. 7B identifies features useful in a tab and label feeding attachment of high durability, longevity and simplified field maintenance. Slots 21*a*-1 constrain the indexing slide arms. The indexing slide arms are held inside slots 21*a*-1 by housing retaining covers 21*c* and 21*d*. Additional cutouts 21*a*-10 in slots 21*a*-1 provide for indexing slide movement. The housing support also has circular holes 21*a*-2 having at least two different diameters. The smaller diameter provides clearance for a gear shaft. The larger diameter provides a "shelf" to support the indexing slide gears and also acts as a lubricant reservoir. Housing support structure area 21*a*-3 provides a channel into which the contacting plunger is depressed. This area may optionally include pins 21*a*-4 that further direct the vertical direction of the plunger and prevent side wear on area 21*a*-3.

Added to the housing support structure are means for fixing the tab and label pressure spring 56. In this example, slots 21*a*-5 are illustrated. Alternately, holes may be provided to capture ends of the spring. Although slots 21*a*-5 are illustrated as extending through the complete thickness of the housing, this is not required. When the housing is formed by machining an extrusion, it is convenient to machine the slots from the exterior, and therefore extend through the complete thickness. If the housing structure is instead precision cast, slots 21*a*-5 may be revised to indentions on the interior portions of the housing.

The housing structure 21*a* has features to allow the easy insertion, retention and removal of a magazine. Slots 21*a*-7 allow the magazine tabs to extend outside the housing. Slots 21*a*-6 accommodate an anchoring feature of the magazine. In this example the magazine anchoring feature is a linear tab that is depressed then expands into the slot. Slots 21*a*-6 are modified when the magazine anchoring feature changes. For example, holes are useful for circular anchoring features of a magazine.

The housing also provides for attachment to a staple gun means and other components of the tab and label feeding attachment. Four drilled and tapped holes 21*a*-8 are used for attaching to a staple gun by using setscrews. Other fastening means such as detent pins or other fasteners could similarly be used. Similarly, holes 21*a*-9 are drilled and tapped for attaching various components. For example two to six holes may be used to attach retainer covers 21*c* and 21*d*. In addition, holes are drilled and tapped for attaching front housing structure 21*b*.

Figure 7C:
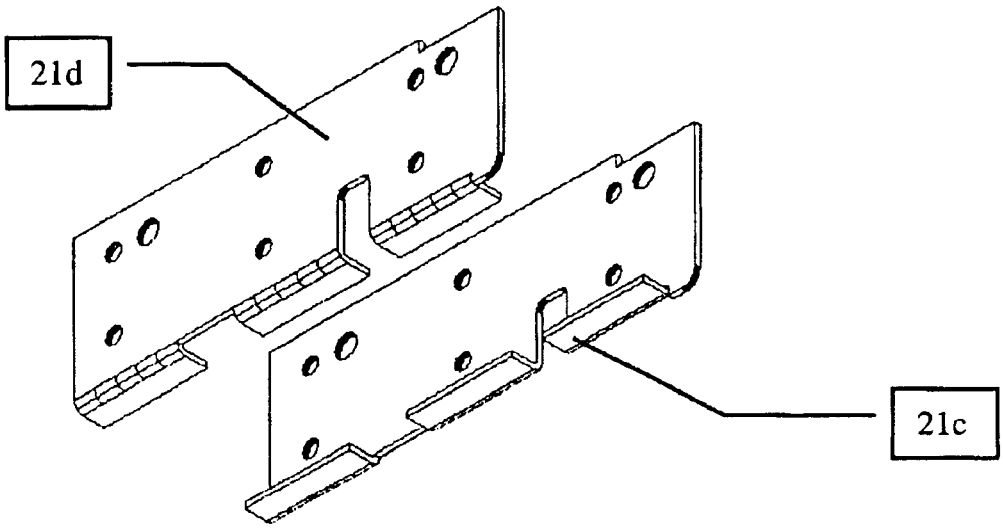
FIG. 7C illustrates a retaining covers of the tab and label feeding attachment of FIG. 6.

FIG. 7C illustrates housing retaining covers 21*c* and 21*d*. Covers include a relatively large planar face and tabs provided perpendicular thereto. The tabs act to restrain indexing slide arms within the slots of the housing support structure (see FIG. 7B, slots 21*a*-1 with cutouts 21*a*-10). As can be seen in FIG. 7C retaining covers 21*c* and 21*d* have cutouts and holes corresponding to attachment features of the housing support structure. For example, tabs have cutouts for the indexing slide and magazine retaining tabs. Holes correspond to attachment holes for the retaining covers as well as set screws used to affix the housing support structure to the staple gun means.

Figure 7D:
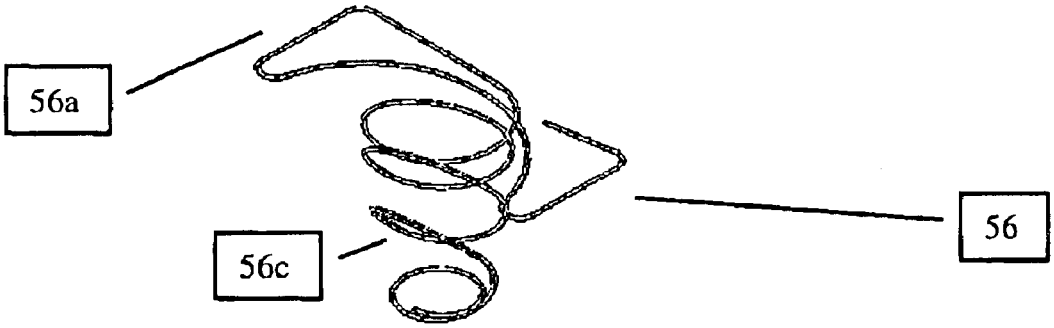
FIG. 7D and FIG. 7E illustrate a tab and label pressure spring of the tab and label feeding attachment of FIG. 6.
Figure 7E:
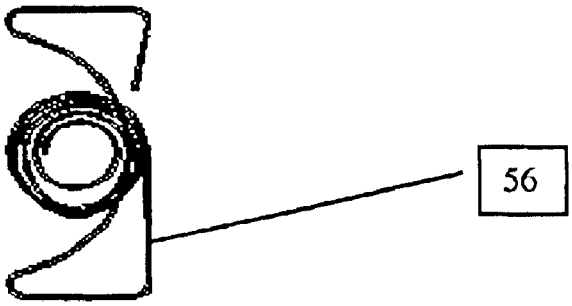

FIG. 7D and FIG. 7E illustrate the tab and label pressure spring 56 of this embodiment. FIG. 7D is an isometric view and FIG. 7E is a plan view. Pressure spring 56 consists of a traditional spring 56*c* integral with a support base 56*a*. The support base 56*a* is configured to adapt to spring anchoring means in the housing support structure. For example, spring 56 as shown, adapts to slots 21*a*-6 of FIG. 7B.

FIG. 7E is a plan view of pressure spring 56. Of importance is the fact that spring 56 compresses to a single wire thickness. This allows for the maximum number of labels or tabs in the accompanying magazine.

Figure 7F:
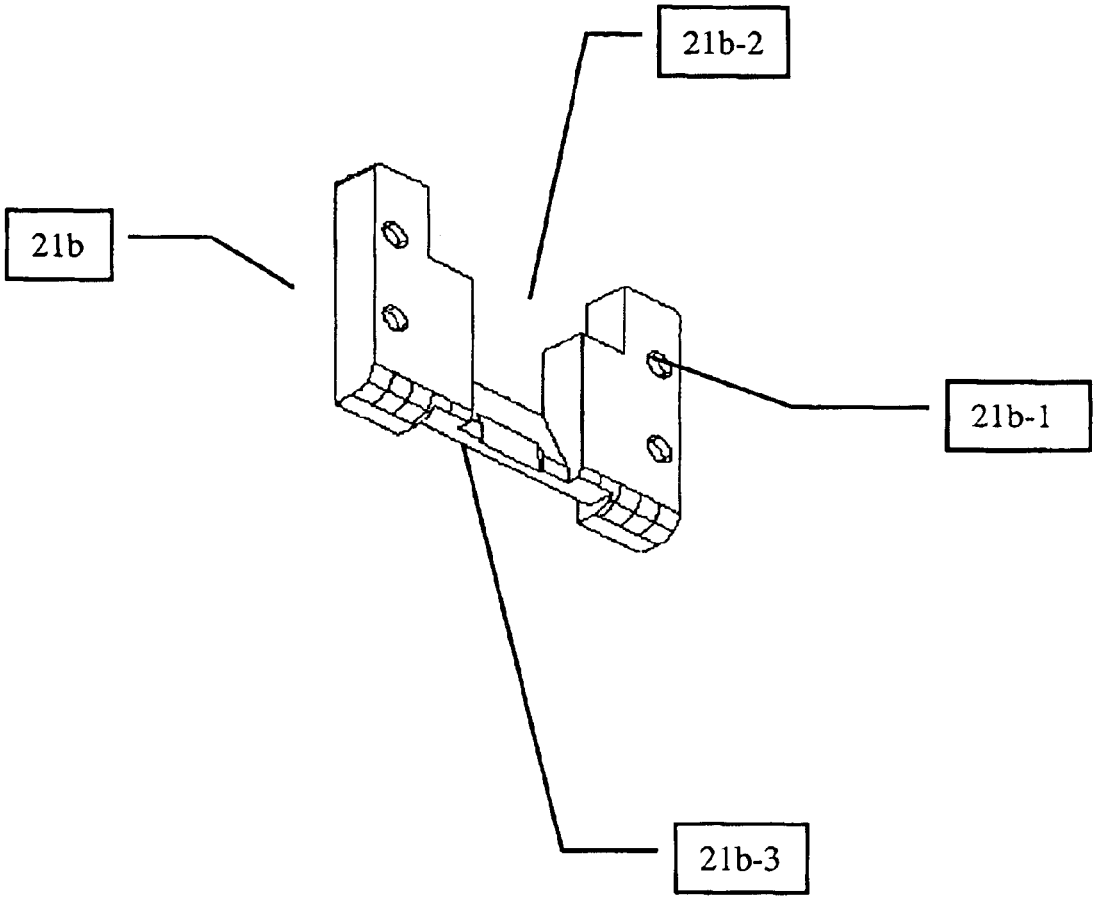
FIG. 7F illustrates a front housing structure of the tab and label feeding attachment of FIG. 6.

Front housing structure 21*b* is illustrated in greater detail in FIG. 7F. Holes 21*b*-1 attach front housing structure 21*b* to the housing support structure. Cutouts 21*b*-2 on the face mirror features on the staple gun means. As shown, cutouts 21*b*-2 mirror features on a Behrens staple gun means. By varying the cutouts, the tab and label feeding apparatus is adapted to large numbers of different staple gun means. On the back of front housing structure 21*b* is a bevel 21*b*-3. This bevel aids in feeding of labels and tabs.

Figure 8A:
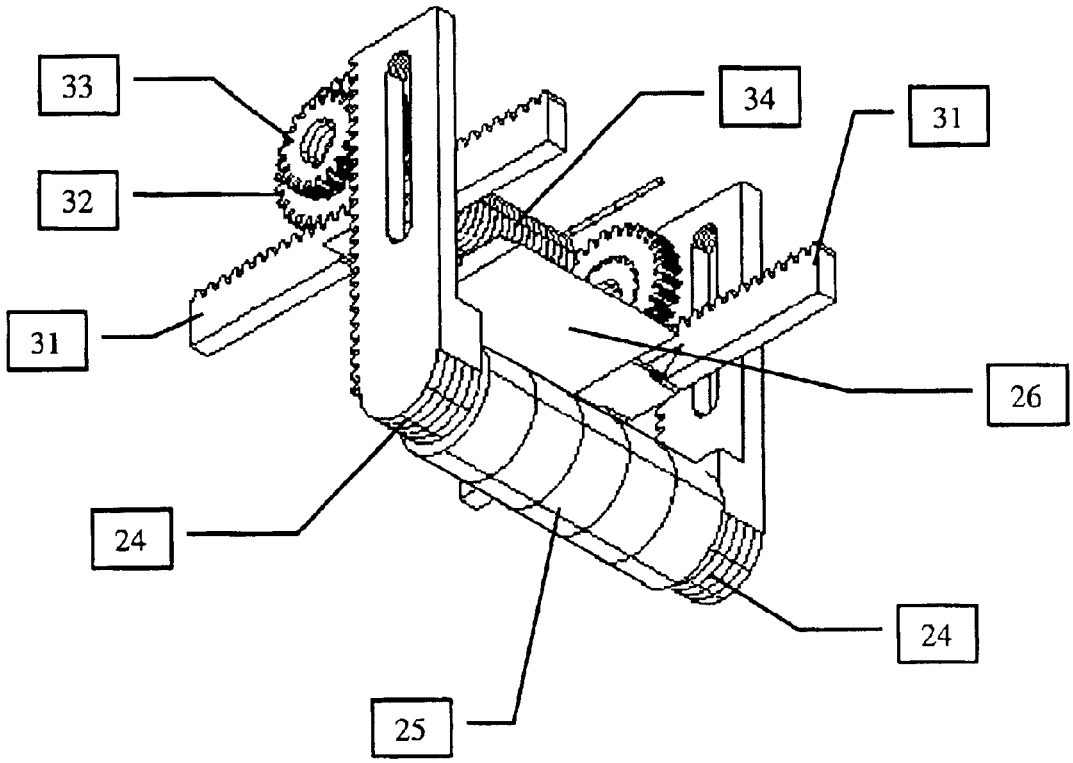
FIG. 8A illustrates a tab and label feeding means of the tab and label feeding attachment of FIG. 6.
Figure 8B:
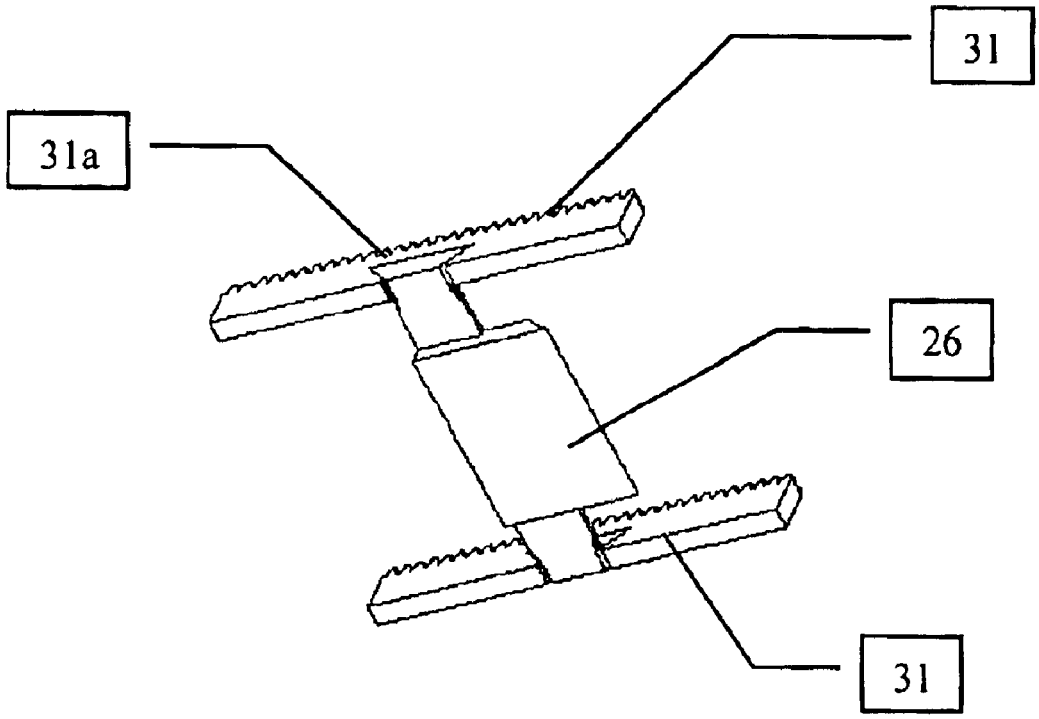
FIG. 8B illustrates an indexing slide of the tab and label feeding attachment of FIG. 6.
Figure 8C:
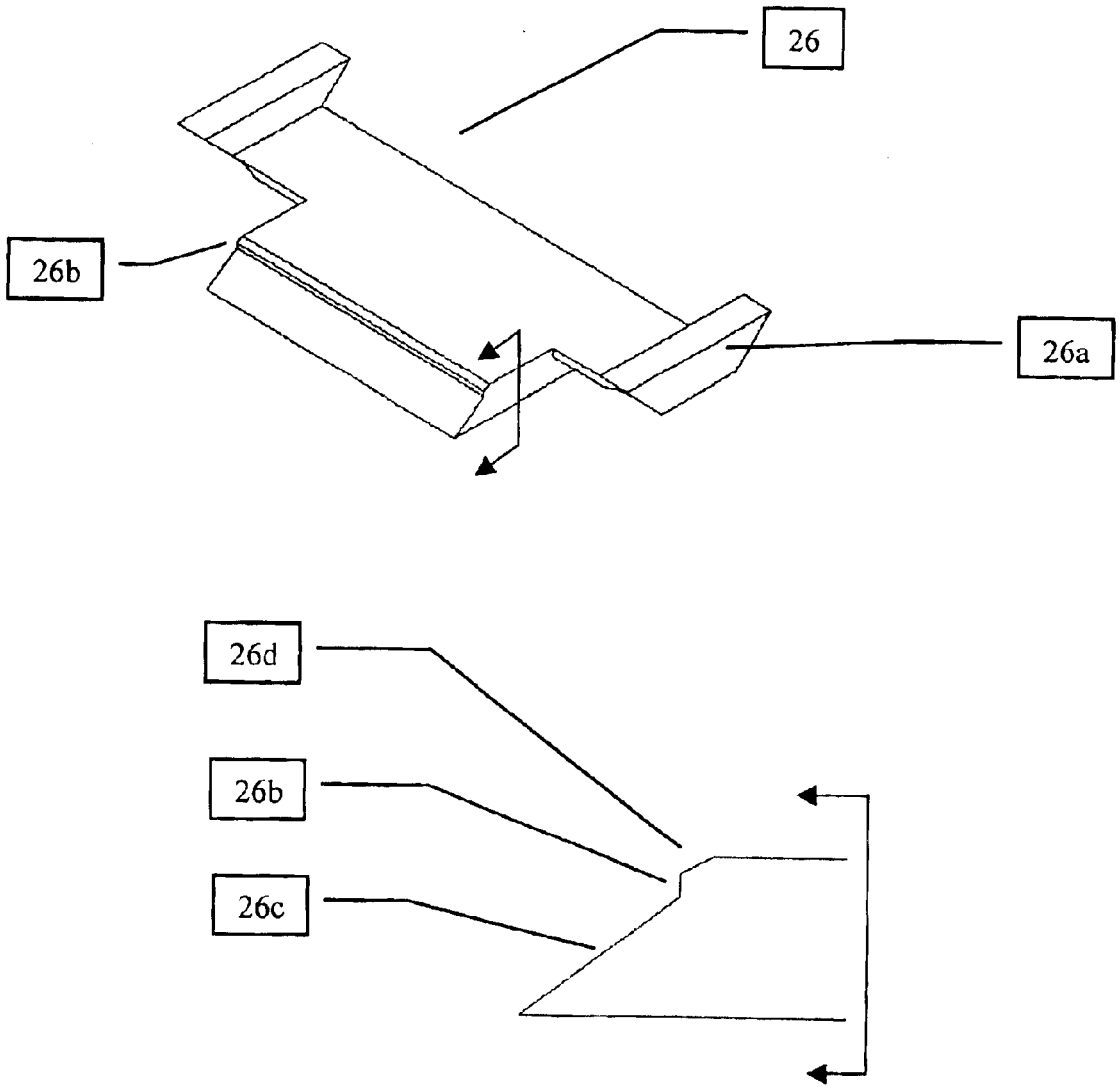
FIG. 8C illustrates an indexing slide assembly of the tab and label feeding attachment of FIG. 6.

The components of the tab and label feeding means of this embodiment are illustrated in FIGS. 8A through 8C. As seen in FIG. 8A, gears 32 and 33 mesh with indexing slide arms 31 and contacting plungers 24. Gears 32 and 33 may be combined into a single gear or be a pair of gears that are fixedly attached to one another. Two sets of gears are provided, one set for each indexing slide arm. While a single set of gears is sufficient, using two sets improves slide travel and reduces binding of the slide arms.

The diameter ratio between gear 32 vs. gear 33 controls the amount of travel of indexing slide 26. Increasing gear 32 diameter, relative to gear 33 diameter, increases slide 26 travel. The sets of gears are connected with a gear shaft that is not visible due to the presence of torsion spring 34. Torsion spring 34 is threaded through a hole in the gear shaft and returns indexing slide 26 to a home position when contacting plungers 24 are released.

Contacting plungers 24 and contacting surface 25 may be a single integral component, or a combination of separate components. As illustrated, contacting plungers are connected with a roller shaft that supports a roller as contacting surface 25. Using a roller as contacting surface 25 reduces cuts and damage to protective coverings. Suitable rollers may be manufactured of virtually any machinable or castable material including aluminum, nylon, polypropylene, polyethylene, wood, and the like.

One surface of each contacting plunger 24 is provided with a rack that meshes with gear teeth of gears 33. As the plunger moves upward, gears 33 rotate in a counterclockwise rotation. The rotation of gears 33 is then communicated to gears 32 that are fixedly attached to gears 33. The rotation of gears 32, in turn, is communicated to the rack of the indexing slide arms, giving a resultant planar motion, perpendicular to the movement of contacting plungers 24.

Torsion spring 34 resists the rotation of the gears and causes the gears to rotate in a clockwise direction when contacting plungers 24 are released. The spring tension of torsion spring 34 is selected to provide adequate force to return the indexing slide to its home position. At the same time the spring tension is limited so that excessive force is not required to depress contacting plungers 24.

FIG. 8B and FIG. 8C illustrate the indexing slide and indexing slide arms in greater detail. As shown in FIG. 8B, indexing slide 26 may be separately fabricated and attached to indexing slide arms 31. As an alternate, indexing slide 26 and slide arms 31 may be fabricated as a single component. As shown, indexing slide arms 31 are fabricated with a gear rack that meshes with gears of the tab and label feeding means. When slide arms 31 are separately fabricated, they may be connected to indexing slide by any means common in the art. As shown for illustration and not as a limitation, a dovetail joint is provided with a dovetail slot fabricated into each slide arm 31 and mating dovetail pins fabricated into indexing slide 26. Dovetail joints may have a positive tolerance to allow the indexing slide to "float" between the two slide arms.

FIG. 8C is a view from underneath indexing slide 26 with an enlarged cross-section of the slide also depicted. As also shown in FIG. 8B, this example of an indexing slide has dovetail pins 26*a* that allow a floating connection to the indexing slide arms. Preferably the indexing slide front edge is fabricated with two surfaces 26*b* and 26*c*. Even more preferable is the inclusion of a third surface 26*d*. Surface 26*b* is the portion of the indexing slide that contacts the edge of the tab or label and is approximately perpendicular to the movement of the indexing slide (e.g. 80–90 degrees).

Surface 26*c* is the front most surface of indexing slide 26 and is angled to encourage a tab or label to seat itself against surface 26*b*. The addition of surface 26*c* reduces occasions of not feeding a tab or label. It has been found that surface 26*c* functions well with tabs when it is at an angle of 15–45 degrees (measured from the movement direction of the slide).

In order to reduce instances of feeding more than a single tab or label, surface 26*d* may also be added to indexing slide 26. A flatter angle is preferred for surface 26*d*. For example, an angle of 15 to 30 degrees has proved advantageous for feeding tabs.

Figure 9B:
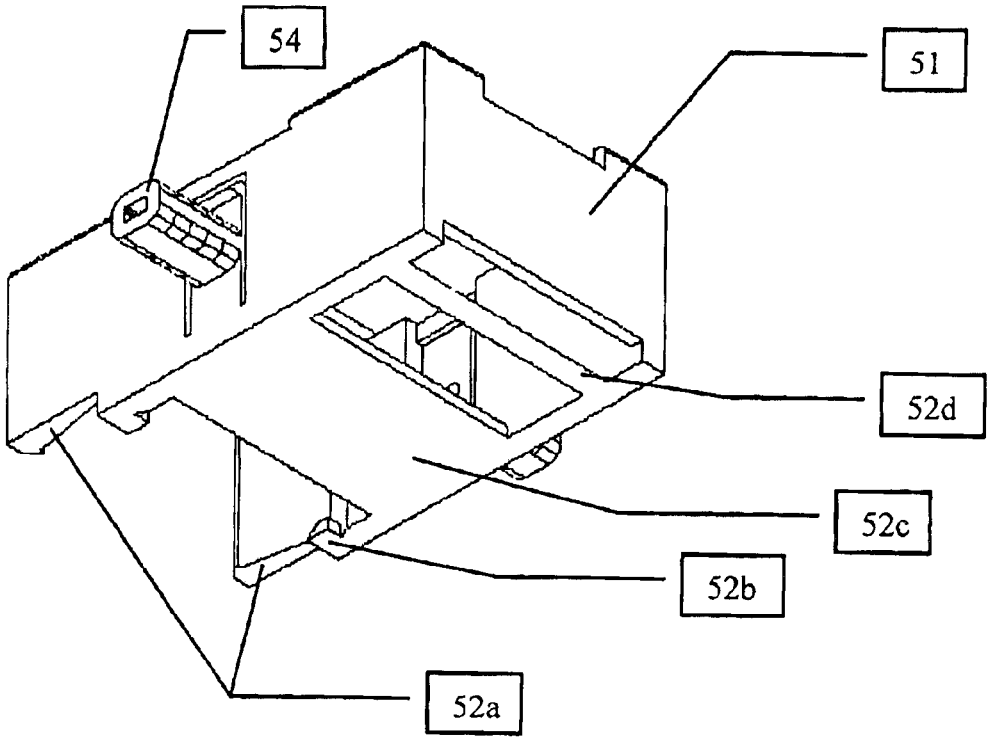
FIG. 9B and FIG. 9C illustrate a tab and label magazine.
Figure 9C:
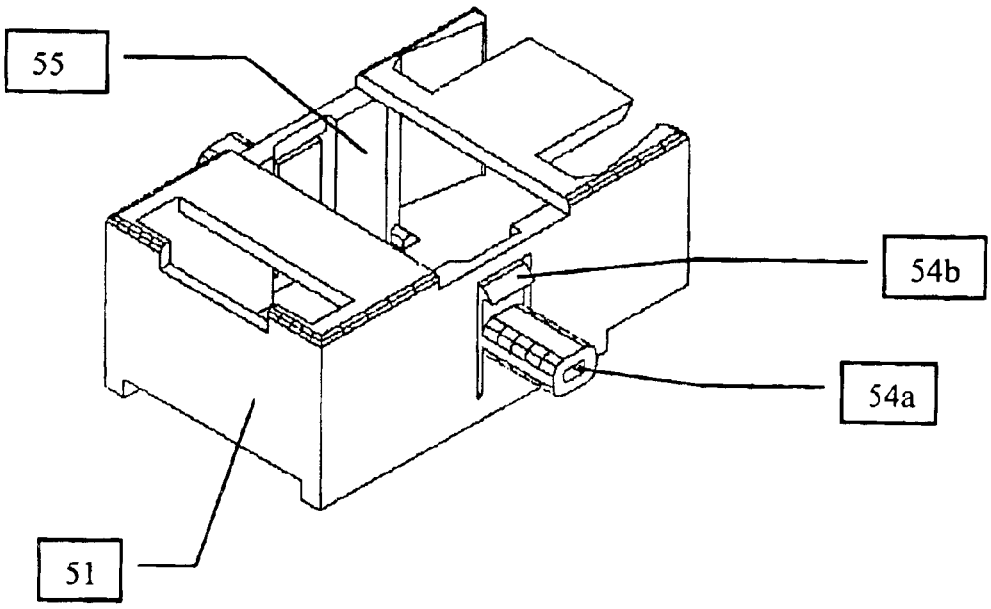

FIG. 9A through FIG. 9C illustrate various views and features of a filled magazine 50 suitable for use with this embodiment of the invention comprising a magazine housing 51 and tabs 58*a* through 58*v*. Twenty-two tabs having an individual tab thickness of 0.035 inches are accommodated by this particular magazine housing 51.

FIG. 9B and FIG. 9C show various isometric views of the same magazine housing 51. In contrast to the tab and label magazine of the first exemplary embodiment, this magazine uses magazine housing 51 without either a pusher plate or coil springs. Lateral supports 54 are used to anchor the magazine into the tab and label feeding apparatus. Uppermost lip 54*b* clamps into corresponding slot 21*a*-6 of FIG. 7B. When horizontal extensions 54*a* are compressed, the magazine is released from the feeding apparatus. Pressure spring 56 of FIG. 7B aids in removal of an empty magazine.

FIG. 9B makes visible the top of outermost surface of magazine 51. Between end retaining flaps 52*a* is the opening that is most frequently used to fill the magazine with tabs or labels. Tabs are filled from this end and exit through the slot near feed retaining bar 52*d*. Tabs are constrained in a relatively flat orientation by retaining tabs 52*b*, outermost surface 52*b*, main constrainer 52C and feed retaining bar 52*d*. FIG. 9C shows the opposing innermost surface of magazine 51. Of particular interest is open area 55 that allows the pressure spring to press tabs or labels against outermost surface 52*b*, shown in FIG. 9B.

The present invention may use various indexing means known in the art. For example, the first embodiment illustrates the use of a worm gear and the second embodiment illustrates the use of a rack and pinion.

Figure 10A:
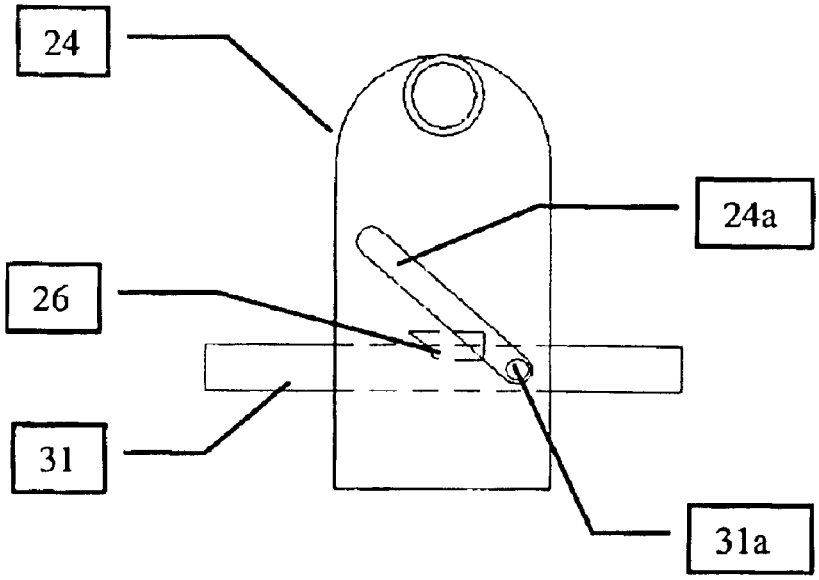
FIG. 10A illustrates an indexing means comprising a slot and post.
Figure 10B:
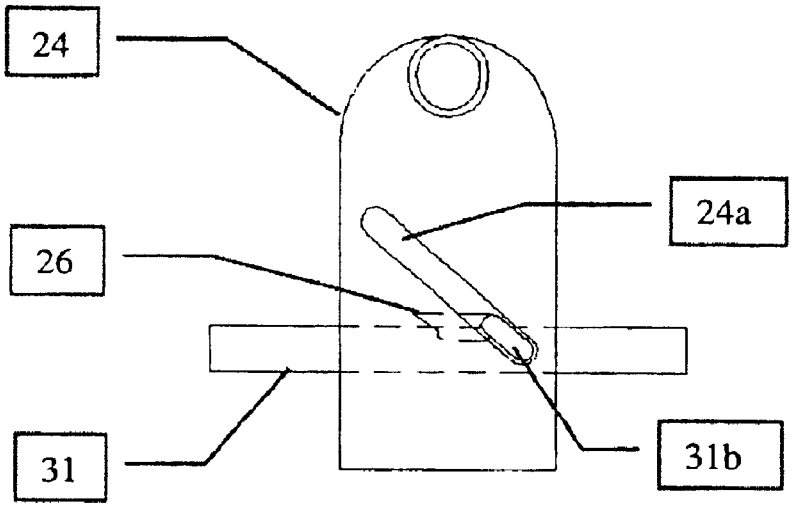
FIG. 10B illustrates an indexing means comprising a slot and key.

FIG. 10A and FIG. 10B illustrate how slots in the contacting plungers are used as the indexing means. In FIG. 10A, slot 24*a* is provided in contacting plunger 24. Post 31*a* is integral or attached to slide arms 31 that are, in turn, attached to or integral with indexing slide 26. Slide arms 31 have their movement constrained to the left-right directions. As contacting plunger 24 is depressed the indexing slide is forced forward by slot 24*a* acting on post 31*a*.

FIG. 10B illustrates the use of key 31*b* instead of a post. As contacting plunger 24 is depressed the indexing slide is forced forward by slot 24*a* acting on key 31*b*. The width of contacting plunger 24 and length of slot 24*a* in FIG. 10A and FIG. 10B must accommodate the amount of forward travel needed for indexing slide 26. In addition, the angle of the slot is adjusted for the vertical travel of plunger 24. The angle must also be sufficiently distinguished from horizontal to effect easy movement of the indexing slide. In general an angle of between 30 and 60 degrees is preferred.

Figure 11:
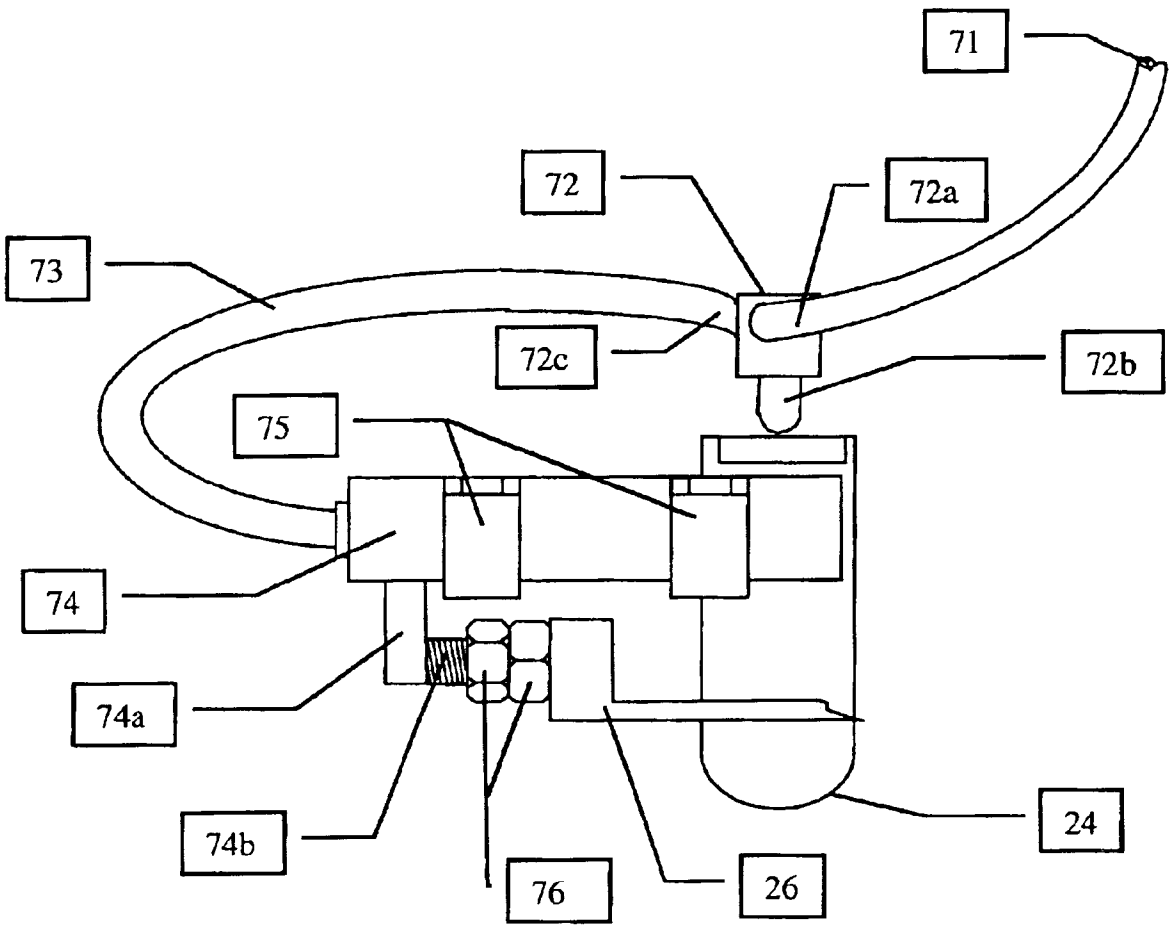
FIG. 11 illustrates a tab and label feeding means comprising a piston assembly.

FIG. 11 illustrates a tab and label feeding means comprising a piston assembly that is suitable for use in the invention. Pneumatic piston 74 operates on air pressure applied and vented through tubing 73. Air valve 72 is connected via tubing 71 to pressurized air supply. Preferably, pressurized air supply is obtained from staple gun means air supply.

When contacting plunger 24 is depressed, it presses on air valve trigger plunger 72*b* causing pressurized air to flow from air valve inlet 72*a* to air valve outlet 72*c*. Pressurized air causes piston 74 arm 74*a* to extend that in turn extends indexing slide 26 connected with connector 74*b*. As illustrated, connector 75*b* is a threaded connection that may optionally use locknuts 74. Other types of connectors may be used as know in the art.

When contacting plunger 24 is released, the piston returns to its home position, which retracts indexing slide 26. Piston 74 is secured in the label and tab feeding attachment with brackets 75. Piston 74 and air valve 72 operate independently of the staple gun thereby allowing the staple gun means to be used without stapling into a tab or label.

Another variation of using a pneumatic piston assembly as the tab and label feeding means is to mount air valve 72 to the handle of the staple gun means. In this variation, the operator would press air valve plunger 72*b* directly, thereby eliminating contacting plunger 24. After a tab or label is fed, the staple gun means would then be separately activated.

When used with "lumber wrap" protective coverings, the present invention is particularly useful. Preferably lumber wrap is secured with staples and tabs. It is often desirable that the tabs be a similar material as the lumber wrap in order to facilitate recycling. Typical tabs for securing lumber wrap are from 0.015 to 0.050 inches thick with planar dimensions large enough to reduce over 90% of staple pull-throughs. For example, planar dimensions greater than or equal to 0.75 inches square are suitable.

Larger planar dimensions are advantageous in bridging separate lumber pieces incorporated into a single lumber product package. For example, planar size of 1 inch by 2 inches both prevents staple pull throughs and is adequate for bridging. By varying the dimensions of the tab and label feeding attachment, the invention can be used with tabs having dimensions of from 0.75 to 1.5 inches in width and from 0.5 to 6.0 inches in length.

The present apparatus permits stapling the lumber wrap to a wood unit product with an indexed tab as well as without a tab. This is apparent as tabs are only indexed when the contacting plungers are depressed. The staple gun means continues to function normally when the plungers are note depressed and a tab is not indexed. Being able to use the staple gun means without indexing a tab conserves the number of tabs used. Many suppliers of lumber wrap incorporate reinforced areas for stapling. When the reinforced areas correspond to a convenient stapling area, a stapling tab may be avoided. However, as the reinforced areas inevitably do not correspond to all needed stapling areas, a certain number of tabs must be used. Users of the invention can conveniently staple reinforced areas without tabs and then staple un-reinforced areas with tabs.

Just as the staple gun means can be used without a tab, it can also be used to apply multiple staples in and through a single tab. Typically, a tab is indexed by depressing the contacting plunger and the staple gun is triggered, driving a first staple through the tab, through the lumber wrap and into the wood product. The staple gun is next positioned in a new location and a second staple is driven through the same tab, lumber wrap and into the wood product. In order to not feed a second tab, the staple gun is repositioned without releasing the plungers or with releasing the plungers but keeping the plungers released. If desired a third, fourth, or higher numbered staple may be similarly driven. This ability of using multiple staples on a single tab, allows tabs to better secure protective coverings, allows tabs to bridge separate pieces of a product and reduces the number of tabs used in securing a protective covering.

Although the present invention has been described in terms of specific embodiments, other variations can be made as will be known to those skilled in the art. For example, the accessory and roller assembly can be combined into a single unit or fully integrated into a staple gun. Similarly, materials other than those illustrated may be used in fabrication of the apparatus. The scope of the invention is only to be limited by the following claims:

What is claimed is:

1. Tab and label stapler apparatus comprising a staple gun means, a tab and label feeding attachment connected thereto and tab and label magazine;

wherein the staple gun means is associated with said apparatus and operable to deliver a penetrating fastening means into a fixing surface;

wherein a tab and label magazine provides a receptacle for a plurality of planar material segments useful as labels and tabs;

wherein the tab and label feeding attachment retains the tab and label magazine;

wherein the tab and label feeding attachment comprises a depressible contacting means and an indexing means;

wherein the depressible contacting means and the indexing means are mechanically linked so that the indexing means positions a planar material segment between the penetrating fastening means and the fixing surface when the depressible contacting means is depressed as it is contacted against the fixing surface;

wherein the indexing means moves to a retracted position when the depressible contacting means is released;

wherein the retracted position is suitable for indexing a subsequent planar material segment; and wherein the staple gun means operates to force the penetrating fastening means through a planar material segment positioned by the indexing means into the fixing surface.

2. The apparatus of claim 1 wherein in the tab and label feeding attachment is a highly compact tab and label feeding attachment.

3. The apparatus of claim 2 wherein in the tab and label feeding attachment further comprises a housing, attachment means, contacting plunger, and a torsion spring assembly.

4. The apparatus of claim 3 wherein the planar material segments are tabs of thickness from 0.015 to 0.050 inch and planar dimensions larger than 0.75 inches.

5. The apparatus of claim 3 wherein the tabs are of thickness from 0.030 to 0.035 inch and of planar dimensions from 0.75 to 1.5 inches in width and from 0.75 to 6 inches in length.

6. The apparatus of claim 3 wherein the indexing means further comprises a motion translation means selected from the group of motion translation means consisting of rack and pinion, worm gear and drive gear, slot and post, slot and key, and cam and follower.

7. The apparatus of claim 6 wherein the motion translation means is a rack and pinion.

8. The apparatus of claim 3 wherein the contacting plunger further comprises a roller assembly attached at the outermost portion of the plunger.

9. The apparatus of claim 3 further comprising a pressure spring fixedly attached to the tab and label feeding attachment housing.

10. The apparatus of claim 9 wherein the magazine housing further comprises tab and label retaining means comprising two retaining tabs, an outermost surface and a feed retaining bar.

11. The apparatus of claim 10 wherein the magazine housing is manufactured of a polymer selected from the group of polymers consisting of polypropylene, polyethylene, acrylonitrile-butadiene-styrene, polyamide, polytetrafluoroethylene, polyvinyl chloride, and polyvinylidene fluoride.

12. The apparatus of claim 2 wherein the tab and label magazine further comprises a magazine housing, one or more coil springs and a pusher plate.

13. The apparatus of claim 12 wherein the magazine housing further comprises a lateral support and a capturing element on each of two parallel sides of the magazine housing.

14. The apparatus of claim 12 wherein the magazine housing is manufactured of a polymer selected from the group of polymers consisting of polypropylene, polyethylene, polyamide, polytetrafluoroethylene, acrylonitrile-butadiene-styrene, polyvinyl chloride, and polyvinylidene fluoride.

15. The apparatus of claim 2 wherein the front most edge of the indexing means comprises three zones configured for a planar material segment useful as a tab, wherein the front most zone is at an angle from 30 to 45 degrees, wherein the rear most zone is at an angle from 15 to 30 degrees, wherein the intermediate zone is at an angle of approximately 90 degrees, and wherein the thickness of the intermediate zone is within 0.005 inches of the thickness of the planar segment useful as a tab.

16. The apparatus of claim 2 further comprising a front guide assembly attached to the staple gun.

17. The apparatus of claim 16 wherein the front guide assembly further comprises a roller assembly attached at the outermost portion of the front guide assembly.

18. The apparatus of claim 2 wherein the tab and label magazine accommodates a minimum of 18 tabs.

19. The apparatus of claim 1 wherein the staple gun means is pneumatically operable.

20. The apparatus of claim 1 wherein the staple gun means is electrically operable.

21. The apparatus of claim 20 wherein the staple gun means further comprises a battery means for supplying electrical energy and wherein the battery means is integrally attached to the staple gun means.

22. The apparatus of claim 1 wherein the penetrating fastening means are wire staples having a wire gauge selected from the group of gauges consisting of 14, 15, 16, 18, 20, 22 gauge and a crown dimension selected from the group of dimensions of 3/16" and 3/4".

23. The apparatus of claim 1 wherein the staple gun is a Behrens Model 380.

24. Tab stapler apparatus comprising a staple gun means, a tab feeding attachment connected thereto and tab label magazine;

wherein the staple gun means is associated with said apparatus and operable to deliver a penetrating fastening means into a fixing surface;

wherein the tab feeding attachment comprises a depressible contacting means, housing, attachment means, contacting plunger, torsion spring assembly, and an indexing means;

wherein a tab magazine provides a receptacle for a plurality of planar material segments useful as tabs;

wherein the tab feeding attachment retains the tab magazine;

wherein the depressible contacting means and the indexing means are mechanically linked so that the indexing means positions a planar material segment between the penetrating fastening means and the fixing surface when the depressible contacting means is depressed as it is contacted against the fixing surface;

wherein the indexing means moves to a retracted position when the depressible contacting means is released;

wherein the retracted position is suitable for indexing a subsequent planar material segment;

wherein the staple gun means operates to force the penetrating fastening means through a planar material segment positioned by the indexing means into the fixing surface; and wherein the indexing means further comprises a motion translation means selected from the group of motion translation means consisting of rack and pinion, worm gear and drive gear, slot and post, slot and key, and cam and follower.

25. The apparatus of claim 24 wherein the tab feeding attachment is a highly compact tab feeding attachment.

26. The apparatus of claim 24 wherein the planar material segments are tabs of thickness from 0.015 to 0.050 inch and planar dimensions larger than 0.75 inches.

27. The apparatus of claim 26 wherein the tabs are of thickness from 0.030 to 0.035 inch and of planar dimensions from 0.75 to 1.5 inches in width and from 0.75 to 6 inches in length.

28. The apparatus of claim 24 wherein the front most edge of the indexing means comprises three zones configured for a planar material segment useful as a tab, wherein the front most zone is at an angle from 30 to 45 degrees, wherein the rear most zone is at an angle from 15 to 30 degrees, wherein the intermediate zone is at an angle of approximately 90 degrees, and wherein the thickness of the intermediate zone is within 0.005 inches of the thickness of the planar segment useful as a tab.

29. The apparatus of claim 24 wherein the front of the indexing means further comprises an indexing slide and two indexing slide arms.

30. The apparatus of claim 29 wherein the indexing slide and indexing slide arms are interconnected with a dovetail joint between the indexing slide and each of the indexing slide arms.

31. Tab stapler apparatus comprising a staple gun means, a tab feeding attachment connected thereto and tab magazine;

wherein the staple gun means is associated with said apparatus and operable to deliver a penetrating fastening means into a fixing surface;

wherein a tab magazine provides a receptacle for a plurality of planar material segments useful as labels and tabs;

wherein the tab feeding attachment retains the tab magazine;

wherein the tab feeding attachment comprises a depressible contacting means, housing, attachment means and an indexing means;

wherein the depressible contacting means and the indexing means are pneumatically operated so that the indexing means positions a planar material segment between the penetrating fastening means and the fixing surface when the depressible contacting means is depressed as it is contacted against the fixing surface;

wherein the indexing means comprises a piston assembly;

wherein the indexing means moves to a retracted position when the depressible contacting means is released;

wherein the retracted position is suitable for indexing a subsequent planar material segment; and wherein the staple gun means operates to force the penetrating fastening means through a planar material segment positioned by the indexing means into the fixing surface.

32. The apparatus of claim 31 wherein the tab feeding attachment is a highly compact tab feeding attachment.

33. The apparatus of claim 32 wherein the planar material segments are tabs of thickness from 0.015 to 0.050 inch and planar dimensions larger than 0.75 inches.

34. The apparatus of claim 33 wherein the tabs are of thickness from 0.030 to 0.035 inch and of planar dimensions from 0.75 to 1.5 inches in width and from 0.75 to 6 inches in length.

35. The apparatus of claim 32 wherein the contacting plunger further comprises a roller assembly attached at the outermost portion of the plunger.

36. The apparatus of claim 32 wherein the tab and label magazine accommodates a minimum of 18 tabs.

37. The apparatus of claim 31 wherein the front most edge of the indexing means comprises three zones configured for a planar material segment useful as a tab, wherein the front most zone is at an angle from 30 to 45 degrees, wherein the rear most zone is at an angle from 15 to 30 degrees, wherein the intermediate zone is at an angle of approximately 90 degrees, and wherein the thickness of the intermediate zone is within 0.005 inches of the thickness of the planar segment useful as a tab.

38. The apparatus of claim 31 wherein the tab and label magazine further comprises a magazine housing, one or more coil springs and a pusher plate.

39. The apparatus of claim 38 wherein the magazine housing further comprises a lateral support and a capturing element on each of two parallel sides of the magazine housing.

40. The apparatus of claim 38 wherein the magazine housing is manufactured of a polymer selected from the group of polymers consisting of polypropylene, polyethylene, polyamide, polytetrafluoroethylene, acrylonitrile-butadiene-styrene, polyvinyl chloride, and polyvinylidene fluoride.

41. The apparatus of claim 31 further comprising a pressure spring fixedly attached to the tab and label feeding attachment housing.

42. The apparatus of claim 41 wherein the magazine housing further comprises tab and label retaining means comprising two retaining tabs, an outermost surface and a feed retaining bar.

43. The apparatus of claim 42 wherein the magazine housing is manufactured of a polymer selected from the group of polymers consisting of polypropylene, polyethylene, acrylonitrile-butadiene-styrene, polyamide, polytetrafluoroethylene, polyvinyl chloride, and polyvinylidene fluoride.

44. The apparatus of claim 31 further comprising a front guide assembly attached to the staple gun.

45. The apparatus of claim 31 wherein the staple gun means is pneumatically operable.

46. The apparatus of claim 31 wherein the penetrating fastening means are wire staples having a wire gauge selected from the group of gauges consisting of 14, 15, 16, 18, 20, 22 gauge and a crown dimension selected from the group of dimensions of 3/16" and 3/4".

47. The apparatus of claim 31 wherein the staple gun is a Behrens Model 380.

* * * * *